US007094748B2

(12) United States Patent
Ofosu-Asante et al.

(10) Patent No.: US 7,094,748 B2
(45) Date of Patent: Aug. 22, 2006

(54) SOIL REDEPOSITION INHIBITION AGENTS AND SYSTEMS

(75) Inventors: Kofi Ofosu-Asante, Cincinnati, OH (US); Matthew Edward Volpenhein, Cincinnati, OH (US); Dean Larry DuVal, Lebanon, OH (US); Sheri Anne Hunt, West Chester, OH (US); Eugene Joseph Pancheri, Montgomery, OH (US); Mary Jane Combs, Cincinnati, OH (US); Ronald Allen Swift, II, West Chester, OH (US); Barbara Kay Williams, West Chester, OH (US); Pamela Ann Rockwell, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 286 days.

(21) Appl. No.: 10/074,062

(22) Filed: Feb. 12, 2002

(65) Prior Publication Data

US 2002/0150431 A1 Oct. 17, 2002

Related U.S. Application Data

(60) Provisional application No. 60/268,171, filed on Feb. 12, 2001.

(51) Int. Cl.
*C11D 3/12* (2006.01)

(52) U.S. Cl. ..... 510/517; 510/276; 510/281; 510/285; 510/287; 510/295; 510/299; 510/519; 510/400; 8/142; 8/137; 252/8.62

(58) Field of Classification Search ..... 8/142, 8/137; 252/8.62; 510/276, 281, 285, 287, 510/295, 299, 519, 517, 400
See application file for complete search history.

(56) References Cited

U.S. PATENT DOCUMENTS

| | | | | |
|---|---|---|---|---|
| 3,859,225 | A | 1/1975 | McKnight et al. | 510/287 |
| 4,041,205 | A * | 8/1977 | Compa et al. | 428/220 |
| 4,448,699 | A * | 5/1984 | Barrat et al. | 510/513 |
| 4,876,023 | A * | 10/1989 | Dickenson et al. | 510/296 |
| 4,913,828 | A * | 4/1990 | Caswell et al. | 510/297 |
| 5,132,036 | A * | 7/1992 | Falou et al. | 510/277 |
| 5,676,163 | A | 10/1997 | Behan et al. | 131/243 |
| 5,840,675 | A | 11/1998 | Yeazell | 510/417 |
| 6,107,270 | A * | 8/2000 | Smith et al. | 510/516 |

FOREIGN PATENT DOCUMENTS

| | | |
|---|---|---|
| DE | 43 25 882 A1 | 9/1995 |
| EP | 392607 | * 10/1990 |

* cited by examiner

*Primary Examiner*—Charles Boyer
(74) *Attorney, Agent, or Firm*—Mark A. Charles; C. Brant Cook; Kim W. Zerby

(57) ABSTRACT

The present invention relates to soil redeposition inhibiting agents, soil redeposition inhibiting articles comprising such soil redeposition inhibiting agents, method for using such soil redeposition inhibiting articles for removing soils from dry or essentially dry fabrics, and systems employing said soil redeposition inhibiting agents such that soil is removed from dry or essentially dry fabrics exposed to the soil redeposition inhibiting agents.

15 Claims, 11 Drawing Sheets

SOIL REDEPOSITION INHIBITION AGENTS AND SYSTEMS

RELATED APPLICATIONS

This application claims priority under 35 USC 119(e) to U.S. Provisional Application Ser. No. 60/268,171 filed on Feb. 12, 2001.

FIELD OF THE INVENTION

The present invention relates to soil redeposition inhibiting agents, soil redeposition inhibiting articles comprising such soil redeposition inhibiting agents, methods for using such soil redeposition inhibiting articles for inhibiting redeposition of soils, especially soils having a propensity to redeposit onto fabric articles, removed by the soil redeposition inhibiting agents from dry or essentially dry fabric articles, and systems employing said soil redeposition inhibiting agents such that soils, especially soils having a propensity to redeposit onto fabric articles, removed by the soil redeposition inhibiting agents from dry or essentially dry fabrics exposed to the soil redeposition inhibiting agents are inhibited from redepositing onto the fabric articles.

BACKGROUND OF THE INVENTION

Soil redeposition from one garment to another garment in traditional laundry processes is a well-known phenomenon, whether it be aqueous based home laundry processes or solvent based dry cleaning processes. Models explaining this redeposition of soils from one garment to another theorize that this problem is associated with the cleaning process itself. In essence, after the water or solvent plus detergent system removes the soil from one garment, the soil can redeposit onto another garment before wash liquor is rinsed from the treated garments. To prevent this, the cleaning solution must contain ingredients capable of suspending or trapping the soil in the wash liquor, thereby preventing it from redepositing on garments. Given this model, extensive effort has gone into developing detergent systems capable of better soil suspension or trapping within the wash liquor. It is well-known to current practitioners of the art that as the suspension or trapping of soils in the wash liquor improves, the amount of soil redeposition decreases. The problem with this knowledge is that it also limits association of the problem of soil redeposition to cleaning processes involving water or solvents and detergent systems.

Conventionally soils and soil components, especially colorless soils and soil components have thought to have been effectively removed from dry or essentially dry fabrics via the drying process, oftentimes within an automatic clothes dryer. Formulators were of the mindset that the soils were volatilized and/or vaporized and removed from the dryer.

It has been surprisingly found that such soils are not effectively removed from dry or essentially dry fabrics because of the problem of redeposition of such soils onto the fabric after initially removing the soils from the fabrics, especially during the period when the fabric is cooling in temperature, for example when the fabrics are no longer being subjected to additional heat.

Accordingly, there is a need to develop compositions, articles, methods and/or systems to effectively remove soils and soil components from fabrics while inhibiting the redeposition of those soils and soil components onto the fabrics being treated.

SUMMARY OF THE INVENTION

The present invention fulfills the needs described above by providing a soil redeposition inhibiting article comprising:

a) a carrier, typically a housing or reservoir; and b) an effective amount of a soil redeposition inhibiting agent;

wherein said soil redeposition inhibiting agent is contained within said housing such that said soil redeposition inhibiting agent is capable of controlling redeposition of soils and said soil redeposition inhibiting article contains at least enough of said soil redeposition inhibiting agent to provide a reduction in redeposition on a dry or essentially dry fabric upon being exposed to said dry fabrics, especially in a heated environment, as compared to a dry or essentially dry fabric not exposed to said soil redeposition inhibiting agent.

A method for removing and inhibiting redeposition of soils from a soil-containing fabric article comprising placing a soil redeposition inhibiting article according to the present invention in soil influencing proximity of said soil-containing fabric article such that said soil from said soil-containing fabric article is reduced.

A system for removing and inhibiting redeposition of soils from a soil-containing dry or essentially dry fabric article comprising placing the soil-containing dry or essentially dry fabric in soil influencing proximity to a soil redeposition inhibiting agent in accordance with the present invention such that the soil present on the soil-containing dry or essentially dry fabric article is reduced.

The present invention is based on an unexpected observation that volatile soils on garments can and do transfer from one garment to another during refreshing or cleaning processes where larger amounts of water or solvent are not present. These processes include, but are not limited to confined-space appliances such as gas or electric dryers, microwave dryers, steam or fogging cabinets as well as dewrinkling devices, where soils volatilized from one garment surface will be in close proximity to other garment surfaces where redeposition can occur. Moreover, it has been demonstrated that simple or continuous flushing of the contained air within the appliance is not sufficient to prevent redeposition of volatile soils. For example, for trapping soil during treatment in an appliance, such as a dryer, the soil redeposition inhibiting agent may be used as a solution that is added to a solution reservoir within the appliance or as a sheet or article that is added to the appliance.

Current at-home dry cleaning kits are based on the utilization of the dryer to refreshen and dewrinkle garments without immersion in water or solvent based cleaning systems. These products are capable of reducing volatile soil levels on a specific soiled garment, but lack technologies specifically designed to prevent redeposition of volatile soils onto other garments subjected to the cleaning process at the same time.

The present invention couples these non-immersion cleaning processes with technologies specifically designed to prevent volatile soil redeposition, thereby enhancing the refreshing benefit achieved for all garments in the process.

Accordingly, the present invention provides articles, methods, systems, agents that inhibit soil redeposition on dry or essentially dry fabrics.

These and other objects, features, and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

Definitions

Figure 1:
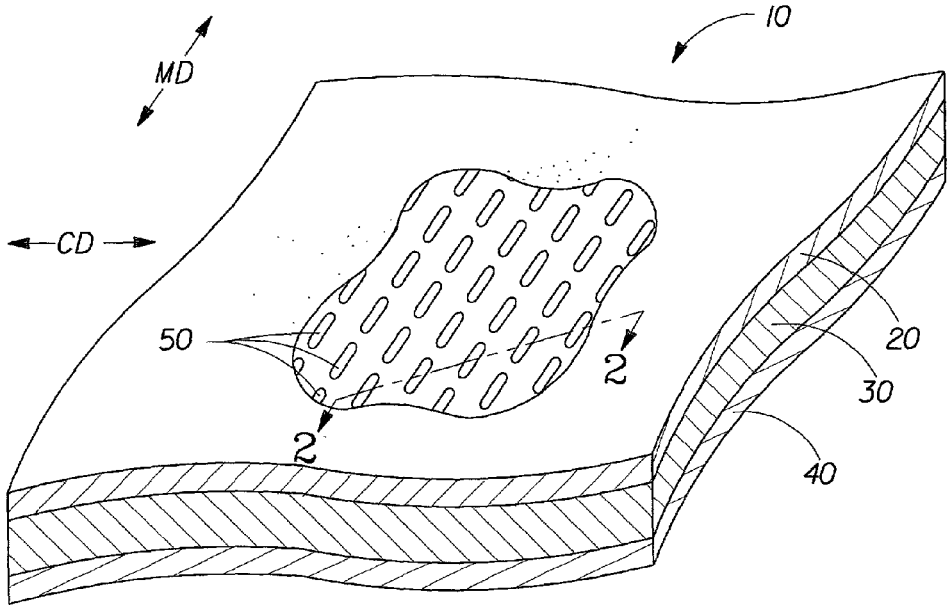
FIG. 1 is a perspective of one embodiment of a laminate web of the present invention.

"Dry or essentially dry fabric article" as used herein means a fabric that comprises less than 25%, typically less than 20%, more typically less than 10%, even more typically less than 5%, most typically less than 3% by weight of the fabric article of free water (or 0.25 grams, 0.20 grams, 0.10 grams, 0.05 grams, 0.03 grams of water per gram of fabric).

"Fabric article" as used herein means any fabric article that is customarily cleaned in a conventional laundry process or in a dry cleaning process, especially those customarily cleaned in a dry cleaning process, otherwise known as "dry cleanable fabric articles". As such the term encompasses articles of clothing, linen, drapery, and clothing accessories. The term also encompasses other items made in whole or in part of fabric, such as tote bags, furniture covers, tarpaulins and the like.

Preferably said fabrics are made of fibers selected from the group consisting of natural fibers, synthetic fibers, and mixtures thereof. More preferably, said fabric is made of fibers selected from the group consisting of: cellulosic fibers, proteinaceous fibers, synthetic fibers, long vegetable fibers and mixtures thereof.

Preferably the cellulosic fibers are selected from the group consisting of cotton, rayon, linen, Tencel®, poly/cotton and mixtures thereof.

Tencel® is a cellulosic fiber made from wood pulp from trees grown on special tree farms in the U.S.A. where the trees are constantly replanted. The fiber is produced via a special "solvent-spinning" process using a non-toxic solvent that is 99% recoverable and recyclable. Because no toxic chemical products are produced during the process, there are no harmful fumes released into the atmosphere. Tencel® has all the characteristics of a luxury fiber: the natural, workable comfort of cotton, the fluid drape and color richness of rayon, the strength of a synthentic and the luxurious hand and luster of silk. Fabrics of Tencel® have exceptional strength, a luxurious hand and fluid drape, are naturally absorbent and comfortable, and accept dyes readily, from pale pastels to rich jewel tones. They also resist wrinkling and shrinkage and are often washable. Tencel® can be combined with other fibers—Tencel® enhances their best attributes. For example, one can combine with linen, rayon, lycra, micro denier polyester and cotton. Tencel®'s high strength enables the production of finer count. Tencel® is commercially available from Courtaulds Fibers, Inc.

Preferably the proteinaceous fibers are selected from the group consisting of silk, wool and related mammalian fibers and mixtures thereof. Preferably the synthetic fibers are selected from the groups consisting of polyester, acrylic, nylon and mixtures thereof. Preferably the long vegetable fibers are selected from the group consisting of jute, flax, ramie, coir, kapok, sisal, henequen, abaca, hemp, sunn and mixtures thereof.

"Soil influencing proximity" as used herein means a distance between the soil redeposition inhibiting article and/or soil redeposition inhibiting agent and a soil-containing fabric article in need of treatment such that the soil redeposition inhibiting agent within said soil redeposition inhibiting article can provide its soil removal and/or redeposition benefit to the soil-containing fabric article.

"Soils" as used herein means any soil that satisfies the following Soil Index, and thus has a propensity to redeposit onto a fabric article after having been removed from a fabric article. Factors that impact whether a soil has a propensity to redeposit are the soil's ClogP and the soil's vapor pressure. A soil's propensity to redeposit is proportional to the ratio of its ClogP divided by its vapor pressure. Soils that have 1) a ClogP of 1 or greater and a vapor pressure of 500 kPa or less at 25° C. and 2) a ClogP of 10 or less and a vapor pressure of 0.3 kPa or greater at 100° C. fall within the definition of "soils" as used herein. For illustrative purposes, the following chart is provided:

| Soils having a ClogP <1 and a vapor pressure >500 kPa at 25° C. | Soils within scope of present invention | Soils having a ClogP >10 and a vapor pressure <0.3 kPa at 100° C. |
|---|---|---|
| A | B | C |

Nonlimiting examples of Group B soils include volatile soils like those found on mechanics' clothes; food handlers, especially butchers' and kitchen workers' clothes; sewer workers' clothes; bar tenders' clothes; fire fighters' clothes; farm clothes; athletic clothing; factory workers' clothes; heavy machinery operators' clothes; etc. Such soils also have a relatively high level of hydrophobic soils such as lubricating oil, grease, food oils, body soils, smoke etc.

Such soils oftentimes contain components such as low molecular weight fatty acids, aldehydes, ketones, mercaptans, amines, and alcohols. The alkyl chain in these molecules are typically contain between two and twelve carbon atoms. However, aromatic molecules within these classes types of molecules can contain up to about 20 carbon atoms.

"Soil-Containing Fabric Article" as used herein means a fabric article containing a soil from Group B above, wherein the fabric article contains less than about 10% moisture before the treatment begins and is exposed to additional moisture during the treatment such that the additional moisture is greater than 1% by dry weight of the fabric article of water and less than 200% by dry weight of the fabric article of water if the fabric article will be dried in an automatic clothes dryer without being contained within a bag, or less than 50% by dry weight of the fabric article of water if the fabric article will be dried in an automatic clothes dryer contained within a bag. If the fabric article is too dry, the Group B soil will not be effectively removed and inhibited from redepositing. If the fabric article is too wet or exposed to too much moisture the effectiveness of the soil redeposition inhibiting agents is reduced because the soils will be retained on the original garment due to low volatilization rates.

"Soil Redeposition Inhibition Agents" as used herein means any suitable agent that is capable of reducing, especially by a factor of 10 or greater and even more, such as by a factor of 100 or greater, the vapor pressure of the Group B soil present on the soil-containing fabric article above. Vapor pressures of soils and/or soil components are known by those of ordinary skill in the art, and are referenced in CRC.

Nonlimiting examples of suitable soil redeposition inhibition agents include the soil redeposition inhibition agent is preferably selected from the group consisting of: cyclodextrin, preferably solubilized, uncomplexed cyclodextrin; class I aldehydes; class II aldehydes; flavanoids; metal salts, zeolite, activated carbon, silicas, doped silicas, zinc oxides, cyclomethicones and mixtures thereof.

a. Cyclodextrin

As used herein, the term "cyclodextrin" includes any of the known cyclodextrins such as unsubstituted cyclodextrins containing from six to twelve glucose units, especially, alpha-cyclodextrin beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many soil molecules can fit into the cavity including many perfume molecules. Therefore, cyclodextrins, and especially mixtures of cyclodextrins with different size cavities, can be used to inhibit soil redeposition caused by a broad spectrum of organic soil materials, which may, or may not, contain reactive functional groups. The complexation between cyclodextrin and soil molecules occurs rapidly in the presence of water. However, the extent of the complex formation also depends on the polarity of the absorbed molecules. In an aqueous solution, strongly hydrophilic soil molecules (those which are highly water-soluble) are only partially absorbed, if at all. Therefore, cyclodextrin does not complex effectively with some very low molecular weight organic amines and acids present on fabrics. As water is removed from fabrics however, e.g., water is being evaporated from moistened fabrics, some low molecular weight organic amines and acids have more affinity and will complex with the cyclodextrins more readily.

The cavities within the cyclodextrin should remain essentially unfilled (the cyclodextrin remains uncomplexed) while in solution, in order to allow the cyclodextrin to absorb various soil molecules when the solution is applied to a surface. Non-derivatized (normal) beta-cyclodextrin can be present at a level up to its solubility limit of about 1.85% (about 1.85 g in 100 grams of water) under the conditions of use at room temperature.

Preferably, the cyclodextrin used in the present invention is highly water-soluble such as, alpha-cyclodextrin and/or derivatives thereof, gamma-cyclodextrin and/or derivatives thereof, derivatized beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(diemethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference. Further cyclodextrin derivatives suitable herein include those disclosed in V. T. D'Souza and K. B. Lipkowitz, CHEMICAL REVIEWS: CYLCODEXTRINS, Vol. 98, No. 5 (American Chemical Society, July/August 1998), which is incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient soil redeposition inhibition performance. Solubilized, water-soluble cyclodextrin can exhibit more efficient soil redeposition inhibition performance than non-water-soluble cyclodextrin when deposited onto surfaces, especially dispensing sheets used in a dryer.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb soils more broadly by complexing with a wider range of soil molecules having a wider range of molecular sizes. Preferably at least a portion of the cyclodextrin is alpha-cyclodextrin and its derivatives thereof, gamma-cyclodextrin and its derivatives thereof, and/or derivatized beta-cyclodextrin, more preferably a mixture of alpha-cyclodextrin, or an alpha-cyclodextrin derivative, and derivatized beta-cyclodextrin, even more preferably a mixture of derivatized alpha-cyclodextrin and derivatized beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

While cyclodextrin is an effective soil absorbing active, some small molecules are not sufficiently absorbed by the cyclodextrin molecules because the cavity of the cyclodextrin molecule may be too large to adequately hold the smaller organic molecule. If a small sized organic soil molecule is not sufficiently absorbed into the cyclodextrin cavity, a substantial amount of soil can remain and/or be redeposited. In order to alleviate this problem, low molecular weight polyols can be added to the composition as discussed hereinafter, to enhance the formation of cyclodextrin inclusion complexes. Furthermore, optional water soluble metal salts can be added as discussed hereinafter, to complex with some nitrogen-containing and sulfur-containing soil molecules.

Since cyclodextrin is a prime breeding ground for certain microorganisms, especially when in aqueous compositions, it is preferable to include a water-soluble antimicrobial preservative, which is effective for inhibiting and/or regulating microbial growth, to increase storage stability of aqueous soil-absorbing solutions containing water-soluble cyclodextrin.

It is also desirable to provide optional ingredients such as a cyclodextrin compatible antimicrobial active that provides substantial kill of organisms. It is also desirable that the compositions contain a cyclodextrin compatible surfactant to promote spreading of the soil absorbing composition on hydrophobic surfaces such as polyester, nylon, etc. as well as to penetrate any oily, hydrophobic soil for improved soil redeposition inhibition control. Furthermore, it is desirable that the cyclodextrin-compatible surfactant provides electrostatic control to reduce the generation of electrostatic energy. It is more preferable that the soil absorbing composition of the present invention contain both a cyclodextrin-compatible antibacterial active and a cyclodextrin-compatible surfactant. A cyclodextrin-compatible active is one which does not substantially form a complex with cyclodextrin in the composition, at the usage concentration, so that an effective amount of both the free, uncomplexed active and free, uncomplexed cyclodextrin are available for their intended uses.

b. Aldehydes

As an optional soil redeposition inhibition agent, aldehydes can be used to mitigate the effects of soils. Suitable aldehydes are class I aldehydes, class II aldehydes, and mixtures thereof, that are disclosed in U.S. Pat. No. 5,676,163, said patent being incorporated herein by reference.

c. Flavanoids

Flavanoids are ingredients found in typical essential oils. Such oils include essential oil extracted by dry distillation from needle leaf trees and grasses such as cedar, Japanese cypress, eucalyptus, Japanese red pine, dandelion, low striped bamboo and cranesbill and it contains terpenic material such as alpha-pinene, beta-pinene, myrcene, phencone and camphene. The terpene type substance is homogeneously dispersed in the finishing agent by the action of nonionic surfactant and is attached to fibres constituting the cloth. Also included are extracts from tea leaf. Descriptions of such materials can be found in JP6219157, JP 02284997, JP04030855, etc. said references being incorporated herein by reference.

d. Metallic Salts

The soil redeposition inhibition agent of the present invention can include metallic salts for added soil absorption and/or antimicrobial benefit, especially where cyclodextrin is also present as a soil redeposition inhibition agent in the composition. The metallic salts are selected from the group consisting of copper salts, zinc salts, and mixtures thereof.

The preferred zinc salts possess soil redeposition inhibition abilities. Zinc has been used most often for its ability to inhibit redeposition of soils, e.g., in mouth wash products, as disclosed in U.S. Pat. No. 4,325,939, issued Apr. 20, 1982 and U.S. Pat. No. 4,469,674, issued Sep. 4, 1983, to N. B.

Shah, et al., all of which are incorporated herein by reference. Highly-ionized and soluble zinc salts such as zinc chloride, provide the best source of zinc ions. Zinc borate can function as a fungistat and a mildew inhibitor, zinc caprylate functions as a fungicide, zinc chloride provides antiseptic and soil redeposition inhibition benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention as a soil redeposition inhibition agent primarily to absorb amine and sulfur-containing compounds. These compounds have molecular sizes too small to be effectively complexed with a cyclodextrin soil redeposition inhibition agent. Low molecular weight sulfur-containing materials, e.g., sulfide and mercaptans, are components of many types of soils, e.g., food soils (garlic, onion), body/perspiration soils, breath soils, etc. Low molecular weight amines are also components of many soils, e.g., food soils, body soils, urine, etc.

Copper salts possess some soil redeposition inhibition abilities. See U.S. Pat. No. 3,172,817, Leupold, et al., which discloses compositions for treating disposable articles, comprising at least slightly water-soluble salts of acylacetone, including copper salts and zinc salts, all of said patents are incorporated herein by reference. Copper salts also have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide.

When metallic salts are added to the composition of the present invention as a soil redeposition inhibition agent, they are typically present at a level of from about 0.1% to an effective amount to provide a saturated salt solution, preferably from about 0.2% to about 25%, more preferably from about 0.3% to about 8%, still more preferably from about 0.4% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

e. Zeolites

A preferred class of zeolites for use in the invention as entrapping agents is characterized as the class of "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for soils, they are more weight efficient for soil absorption and/or redeposition inhibition because they have a larger surface area, and they are more moisture tolerant and retain more of their soil absorbing and/or redeposition inhibition capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100 ® series of zeolites from Conteka.

Zeolite materials marketed under the trade names Abscents and Smellrite, available from The Union Carbide Corporation and UOP are also preferred. These materials are typically available as a white powder in the 3–5 micron particlesize range.

The term "zeolite", as used herein, refers to non-fibrous zeolites. When included in the present invention, zeolites may be present from about 0.1% to about 25%, preferably from about 1% to about 15%, by weight of the body powder composition. A detailed description of zeolites useful in the present invention is found in U.S. Pat. No. 5,429,628, Trinh et al., issued Jul. 4, 1995, incorporated herein in its entirety by reference.

f. Activated Carbon

The entrapping agent can be activated carbon. The carbon material suitable for use in the present invention is known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®.

As used herein activated carbon means absorbent carbon based materials, including activated and reactivated carbons, charcoals and other substantially carbon based absorbents. Activated carbons can be reactivated after initial use and in one embodiment the activated carbon employed is a reactivated coconut carbon. Such activated coconut carbons are available from Cameron/Great Lakes, Inc. of Wasco, Ill. under the trade designation CYPCC and are characterized as having a high surface area and a micropore structure. Activated carbon, including the compound commonly called activated charcoal, is an amorphous form of carbon characterized by high adsorptivity for many gases, vapors and colloidal solids. Carbon is generally obtained by the destructive distillation of coal, wood, nut-shells, animal bones or other carbonaceous materials, including coconuts. The carbon is typically "activated" or reactivated by heating to about 800° C. to about 900° C. with steam or carbon dioxide, which results in a porous internal structure. The internal surfaces of activated carbon typically average about 10,000 square feet per gram.

g. Silica

Silica, preferably in the form of hydrated amorphous silica (often referred to as synthetic precipitated silica can be used as a soil redeposition inhibiting agent in accordance with the present invention.

The silica should have an average particle or aggregate particle size of from about 0.5 microns to about 50 microns. Silica particles often exist in varying forms. When in a powder form, silica particles generally exist as aggregates of ultimate particles of colloidal size. Thus, particulate silica may be characterized by the size of the aggregate collection of ultimate silica particles and by the size of the ultimate particles. Typically, the average ultimate particle size for precipitated silica is from about 0.01 microns to about 0.025 microns. Average aggregate particle size of precipitated silica ranges from about 1 micron to about 10 microns. The average ultimate particle size for fumed silica is from about 0.001 microns to about 0.1 microns. The average aggregate particle size of fumed silica ranges from about 2 microns to about 3 microns.

Absorbent powders comprising mainly silicas for moisture control are preferred over those powders comprising mainly silicates and/or carbonates for moisture control. Most preferred are silicas which are in the form of microspheres and/or ellipsoids, as they have been found to contribute good skin feel characteristics in addition to efficient moisture absorption. Silica ellipsoids useful in the present invention are available from DuPont as ZELEC.RTM. Sil. Silica microspheres are available from KOBO as MSS-500, MSS 500/3, MSS-500/H, MSS-500/3N, MSS-500/N, and MSS-500/3N, from Presperse as Spheron L-1500, Spheron P-1000, Spheron P-1500, and from US Cosmetics as Silica Beads SB-300 and SB-700. Additionally, where increased flowability of the powder is desired, it is preferred that some of the silica of the present invention be fumed silica. Fumed silica is available from Cabot Corporation (Cab-O-Sil. RTM.) and from Degussa (Aerosil.RTM.).

h. Cyclomethicone (Preferably Decamethylcyclomethicone)

Preferred cyclomethicones include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. It should be understood that useful cyclic siloxane mixtures might contain, in addition to the preferred cyclic siloxanes, minor amounts of other cyclic siloxanes including hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture.

i. Sodium Bicarbonate (Baking Powder)

Sodium bicarbonate is known in the art for its use as an odor absorber. An example of sodium bicarbonate and its use as an underarm deodorant is found in U.S. Pat. No. 4,382,079, to Marschner, issued May 3, 1983, which is incorporated herein in its entirety by reference.

In one embodiment, if two or more types of soil redeposition inhibiting agents of the present invention are used together, the two or more types remain physically and/or chemically discrete from one another.

In yet another embodiment, if two or more types of soil redeposition inhibiting agents of the present invention are used together, two or more are physically and/or chemically in contact with one another.

In still another embodiment, if two or more two or more different types of non-volatile soil redeposition inhibiting agents are used together, they may be selected such that they have comparable particle sizes.

It is desirable that the soil redeposition inhibiting agents of the present invention are selected such that the soil redeposition inhibiting agents inhibit redeposition of both hydrophilic and hydrophobic soils.

It is also desirable that the soil redeposition inhibiting agents of the present invention may be selected such that a consumer acceptable visual characteristic of the soil redeposition inhibiting article is achieved. In other words, black colored soil redeposition inhibiting articles would be less desirable because consumers would resist placing a black colored (perceived by consumers as being "dirty") soil redeposition inhibiting article in proximity to their soil-containing dry or essentially dry fabrics articles.

"An effective amount" of the soil redeposition inhibiting agent as defined herein means an amount sufficient to absorb and/or neutralize and/or inhibit redeposition of the soil to the point that the soil is less objectionable, preferably not discernible by the human sense of smell. As discussed herein, for certain soils, the level in the atmosphere around the fabric articles, "head space", should be less than the minimum detectable concentration for that soil. In one embodiment, a the level of soil redeposition inhibiting agent in a soil redeposition inhibiting article is from about 0.0001 grams to about 300 grams of soil redeposition inhibiting agent per article.

In one embodiment, activated carbons and silicas may be present in the soil redeposition inhibiting article. When they are present together, they may be present at a weight ratio of activated carbons to silicas of less than about 1. In another embodiment, they may be present at a weight ratio of activated carbons to silicas of from about 20:80 to about 1:99. In still another embodiment, they may be present at a weight ratio of activated carbons to silicas of from about 1:99 to about 4:96.

For control of soils, beta cyclodextrin and alpha cyclodextrin are preferred. Gamma cyclodextrin has too large a cavity to control most soil molecules. Substituted cyclodextrins can be especially valuable where they are more soluble than the corresponding unsubstituted cyclodextrin. The preferred compositions are concentrated and liquid to minimize packaging while maximizing the speed of action The soil redeposition inhibiting agent(s) of the present invention may be associated with a carrier, such as by adsorption and/or absorption and/or chemically associated and/or phycially associated, more typically the agent(s) may be housed in a housing such that the soil redeposition inhibiting agents are capable of providing their soil redeposition inhibiting benefits without becoming free from the carrier and/or housing. The carrier and/or housing may be selected from the group consisting differential elongation composites, non-woven materials, woven materials, bags, multilaminate sheets capable of allowing exposing the soil redeposition inhibiting agent to the soil to be removed and inhibited from redepositing to maximize the effectiveness of the redeposition inhibiting agent, single unit dispensing units, such as sachets or other containers and/or encapsulating materials that are capable of exposing the soil redeposition inhibiting agents of the present invention to the soil-containing fabrics to be treated, and mixtures thereof.

Notwithstanding the above, using the soil redeposition inhibiting agents alone (in the absence of a carrier, such as a housing or reservoir) is also within the scope of this invention. In such a case, the soil redeposition inhibiting agents may be placed in soil influencing proximity of the soil-containing fabric to be treated.

a. Differential Elongation Composite Sheet

The soil redeposition inhibiting article of the present invention may comprise a differential elongation composite sheet ("DEC"). In a preferred embodiment, the carrier and/or housing comprises a fold resistant article, preferably a fold resistant DEC article. The fold resistant article resists folding which means that the fold resistant article, typically a soil redeposition inhibiting article and/or a cleaning sheet has a tendency to remain in or return to an unfolded state if folding forces are exerted on the soil redeposition inhibiting article and/or cleaning sheet, preferably as compared to conventional soil redeposition inhibiting article and/or cleaning sheets.

As used herein, the term "absorbent article" refers to devices that absorb and contain fluids (e.g., water, cleansers, conditioners, polishes, body exudates). In certain instances, the phrase refers to devices that are placed against or in proximity to the body of the wearer to absorb and contain the various exudates discharged from the body. In other instances, the phrase refers to articles that have the ability to absorb and retain the benefit component until such time when the article is utilized by a consumer for its intended purpose.

The term "disposable" is used herein to describe articles of the present invention which are not intended to be laundered or otherwise restored or extensively reused (i.e., preferably, they are intended to be discarded after 25 uses, more preferably, after about 10 uses, even more preferably, after about 5 uses, and most preferably, after about a single use). It is preferred that such disposable articles be recycled, composted or otherwise disposed of in an environmentally compatible manner. A "unitary" disposable article refers to disposable articles that are formed of separate parts united together to form a coordinated entity so that they do not require separate manipulative parts like a separate holder and liner.

As used herein, the term "nonwoven web", refers to a web that has a structure of individual fibers or threads which are interlaid, but not in any regular, repeating manner. Nonwoven webs have been, in the past, formed by a variety of processes, such as, for example, meltblowing processes, spunbonding processes and bonded carded web processes.

As used herein, the term "microfibers" refers to small diameter fibers having an average diameter not greater than about 100 microns.

As used herein, the term "meltblown fibers" refers to fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter, which may be to a microfiber diameter. Thereafter, the meltblown fibers are carried by the high velocity gas stream and are deposited on a collecting surface to form a web of randomly dispersed meltblown fibers.

As used herein, the term "spunbonded fibers" refers to small diameter fibers that are formed by extruding a molten thermoplastic material as filaments from a plurality of fine, usually circular, capillaries of a spinneret with the diameter of the extruded filaments then being rapidly reduced by drawing.

As used herein, the term "polymer" generally includes, but is not limited to, homopolymers, copolymers, such as, for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to, isotactic, syndiaotactic and random symmetries.

As used herein, the term "elastic" refers to any material which, upon application of a biasing force, is stretchable, that is, elongatable, at least about 60 percent (i.e., to a stretched, biased length, which is at least about 160 percent of its relaxed unbiased length), and which, will recover at least 55 percent of its elongation upon release of the stretching, elongation force. A hypothetical example would be a one (1) inch sample of a material which is elongatable to at least 1.60 inches, and which, upon being elongated to 1.60 inches and released, will recover to a length of not more than 1.27 inches. Many elastic materials may be elongated by more than 60 percent (i.e., much more than 160 percent of their relaxed length), for example, elongated 100 percent or more, and many of these materials will recover to substantially their initial relaxed length, for example, to within 105 percent of their initial relaxed length, upon release of the stretch force.

As used herein, the term "nonelastic" refers to any material which does not fall within the definition of "elastic" above.

As used herein, the term "extensible" refers to any material which, upon application of a biasing force, is elongatable, at least about 50 percent without experiencing catastrophic failure.

The soil redeposition inhibiting articles of the present invention may comprise the following essential components.

i) Material Composition of the DEC Sheet

The soil redeposition inhibiting articles of the present invention may be made of a material, the chemical composition of which is such that the material resists folding, such as a polymer and/or a viscoelastic material. Viscoelastic materials include, but are not limited to, non-Newtonian fluids/materials. Non-Newtonian fluids/materials are known to those of ordinary skill in the art. Viscoelasticity is defined by the following equation, which is well known to those of ordinary skill in the art and is described in Introduction to Rheology; H. A.Bames, J. F. Hutton, K. Walters; Elsevier Publishing; Copyright 1989; ISBN: 0444-871-40-3:

$$G^*=G'+i\,G''$$

where G* is complex shear modulus, G' is storage modulus, G" is loss modulus and i is the square root of −1. The storage modulus (G') is a measure of polymer elasticity while the loss modulus (G") is associated with the viscous energy dissipation (i.e., damping) by the polymer. The ratio of G" to G' is also a measure of damping (also called tan δ):

$$\tan\delta = \frac{G''}{G'}$$

which is a measure of ratio of the dissipated energy to the stored energy.

Modulus is measured by using the glass transition temperature of the material. If a material is at a temperature below, especially well below, its glass transition temperature, the material exhibits more solid properties than non-Newtonian liquid properties. If a material is at a temperature above, especially well above, its glass transition temperature, the material exhibits more non-Newtonian liquid properties than solid properties.

The materials for use in the soil redeposition inhibiting articles of the present invention may have a glass transition temperature, which is below the use temperature (the temperature at which the articles are subjected during use for delivering their intended purpose; namely, soil redeposition inhibition) of the articles of the present invention and a melting point and/or decomposition temperature above the use temperature of the articles.

In another embodiment, the materials for use in the articles of the present invention may have a glass transition temperature below about 15° C. and a melting point above about 200° C., even more preferably, the materials have a glass transition temperature below about 17° C. and a melting point above about 175° C.

In still another embodiment, the materials may have a glass transition temperature below about 20° C. and a melting point above about 150° C.

The materials for use in the soil redeposition inhibiting articles of the present invention may be nonwovens. Suitable nonwoven materials include, but are not limited to, cellulosics, sponges (i.e., both natural and synthetic), formed films, battings, and combinations thereof.

Nonlimiting examples of soil redeposition inhibiting article materials are described in detail in U.S. Pat. No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, which are incorporated herein by reference.

Additional nonlimiting examples of soil redeposition inhibiting article materials may comprise a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference.

As shown in FIG. 1, in accordance with one embodiment of the present invention, the material (laminate web) 10 of the soil redeposition inhibiting article of the present invention comprises at least three layers, webs or plies, disposed in a layered, face-to-face relationship, as shown in FIG. 1. The layers should be sufficiently thin to be processible as described herein, but no actual thickness (i.e., caliper) is considered limiting. A first outer layer and a second outer layer 20, 40 are known, respectively, as the first extensible web having a first elongation to break and as the second extensible web having a second elongation to break. The second outer layer preferably comprises the same material as the first outer layer but may be a different material. At least one third central layer 30 is disposed between the two outer layers. The laminate web 10 is processed by thermal calendaring as described below to provide a plurality of melt bond sites 50 that serve to bond the layers 20, 30 and 40, thereby forming the constituent layers into a unitary web. While the laminate web 10 is disclosed primarily in the context of nonwoven webs and composites, in principle the laminate web 10 can be made out of any web materials that meet the requirements, (e.g., melt properties, extensibility) as disclosed herein. For example, the constituent layers can be films, micro-porous films, apertured films, and the like.

Preferably, the first and second outer layers are nonwovens. Suitable nonwoven materials for the first and second outer layers include, but are not limited to, cellulosics, sponges (i.e., both natural and synthetic), formed films, battings, and combinations thereof. Preferably, the first and second outer layers each comprise materials selected from the group consisting of cellulosic nonwovens, formed films, battings, foams, sponges, reticulated foams, vacuum-formed laminates, scrims, and combinations thereof.

The first and second layers may comprise a variety of both natural and synthetic fibers or materials. As used herein, "natural" means that the materials are derived from plants, animals, insects or byproducts of plants, animals, and insects. The conventional base starting material is usually a fibrous web comprising any of the common synthetic or natural textile-length fibers, or combinations thereof.

Nonlimiting examples of natural materials useful in the layers of the laminate web include, but are not limited to, silk fibers, keratin fibers and cellulosic fibers. Nonlimiting examples of keratin fibers include those selected from the group consisting of wool fibers, camel hair fibers, and the like. Nonlimiting examples of cellulosic fibers include those selected from the group consisting of wood pulp fibers, cotton fibers, hemp fibers, jute fibers, flax fibers, and combinations thereof. Cellulosic fiber materials are preferred in the present invention.

Nonlimiting examples of synthetic materials useful in the layers of the laminate web include those selected from the group consisting of acetate fibers, acrylic fibers, cellulose ester fibers, modacrylic fibers, polyamide fibers, polyester fibers, polyolefin fibers, polyvinyl alcohol fibers, rayon fibers, polyethylene foam, polyurethane foam, and combinations thereof. Examples of suitable synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephalate fiber, dacron; polyolefins such as polypropylene, polyethylene; polyvinyl acetate fibers; polyurethane foams and combinations thereof. These and other suitable fibers and the nonwovens prepared therefrom are generally described in Riedel, "Nonwoven Bonding Methods and Materials," *Nonwoven World* (1987); *The Encyclopedia Americana*, vol. 11, pp. 147–153, and vol. 26, pp. 566–581 (1984); U.S. Pat. No. 4,891,227, to Thaman et al., issued Jan. 2, 1990; and U.S. Pat. No. 4,891,228, each of which is incorporated by reference herein in its entirety.

Nonwovens made from natural materials consist of webs or sheets most commonly formed on a fine wire screen from a liquid suspension of the fibers. See C. A. Hampel et al., *The Encyclopedia of Chemistry*, third edition, 1973, pp. 793–795 (1973); *The Encyclopedia Americana*, vol. 21, pp. 376–383 (1984); and G. A. Smook, *Handbook of Pulp and Paper Technologies*, Technical Association for the Pulp and Paper Industry (1986); which are incorporated by reference herein in their entirety.

Natural material nonwovens useful in the laminate web of present invention may be obtained from a wide variety of commercial sources. Nonlimiting examples of suitable commercially available paper layers useful herein include Airtex®, an embossed airlaid cellulosic layer having a base weight of about 71 gsy, available from James River, Green Bay, Wis.; and Walkisoft®, an embossed airlaid cellulosic having a base weight of about 75 gsy, available from Walkisoft U.S.A., Mount Holly, N.C.

Additional suitable nonwoven materials include, but are not limited to, those disclosed in U.S. Pat. No. 4,447,294, issued to Osborn on May 8, 1984; U.S. Pat. No. 4,603,176 issued to Bjorkquist on Jul. 29, 1986; U.S. Pat. No. 4,981,557 issued to Bjorkquist on Jan. 1, 1991; U.S. Pat. No 5,085,736 issued to Bjorkquist on Feb. 4, 1992; U.S. Pat. No. 5,138,002 issued to Bjorkquist on Aug. 8, 1992; U.S. Pat. No. 5,262,007 issued to Phan et al. on Nov. 16, 1993; U.S. Pat. No. 5,264,082, issued to Phan et al. on Nov. 23, 1993; U.S. Pat. No. 4,637,859 issued to Trokhan on Jan. 20, 1987; U.S. Pat. No. 4,529,480 issued to Trokhan on Jul. 16, 1985; U.S. Pat. No. 4,687,153 issued to McNeil on Aug. 18, 1987; U.S. Pat. No. 5,223,096 issued to Phan et al. on Jun. 29, 1993 and U.S. Pat. No. 5,679,222, issued to Rasch et al. on Oct. 21, 1997; 5,628,097 issued to Benson et al. on May 13, 1997; U.S. Pat. Nos. 5,916,661 and 5,658,639, both issued to Benson et al. on Jun. 29, 1999; each of which is incorporated by reference herein in its entirety.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining web. In the present invention the layers that comprise nonwovens can be prepared by a variety of processes including, but not limited to, air-entanglement, hydroentanglement, thermal bonding, and combinations of these processes.

The less extensible third central layer may also be a nonwoven as described above. Yet, the central layer 30 itself need not be thermally compatible with the outer layers. The central layer 30 need not even be melt processible. It can be, for example, a cellulosic material, such as paper, tissue, paper towel, paper napkins; a metallic material, such as a metallic foil; a woven or knit material, such as cotton or rayon blends; or a thermoset material, such as a polyester or aromatic polyamide film. The central layer 30 can be another nonwoven having suitable properties for processing into an apertured layer. If central layer 30 has a melting point, it is preferably at least about 20° C. higher than the outer layers. The central layer 30, however, need not have a melting point, and may simply experience softening at the calendaring temperatures required to bond the laminate. In certain central layer materials, such as metallic foils, there is not even any softening due to thermal processing of the web.

One of the unexpected advantages of the present invention is the discovery that novel web properties can be exhibited by the choice of central layer 30 disposed between the two outer layers. Preferably, the central layer material is selected from the group consisting of cellulosics, thermoplastic battings, metallic foils, metallic battings, sponges, formed films, and combinations thereof. Suitable materials for the central layer may include those discussed above. It is important, however, that the central layer have a third elongation break that is less than both the first and second outer layers. The wide range of possible central layer materials permits a surprising variety of structures of the present invention, each having beneficial application in a wide assortment of end uses. For example, when outer layers of nonwoven material are used with a central layer of metallic foil, the resulting laminate is a flexible, soft, formable, metallic web that is relatively silent when folded, crumpled or otherwise deformed. Such a material can be used in applications requiring electrical shielding, for example. When a central layer of tissue paper is used, the resulting laminate is a soft, bulky, absorbent web. Such a laminate is suitable for use as a wiping implement, for example. Further, since the laminate web 10 is formed without the use of thermoplastic adhesives, durable, garment-like properties can be obtained. Such laminates can be laundered a number of times before suffering unacceptable wear.

Figure 2:
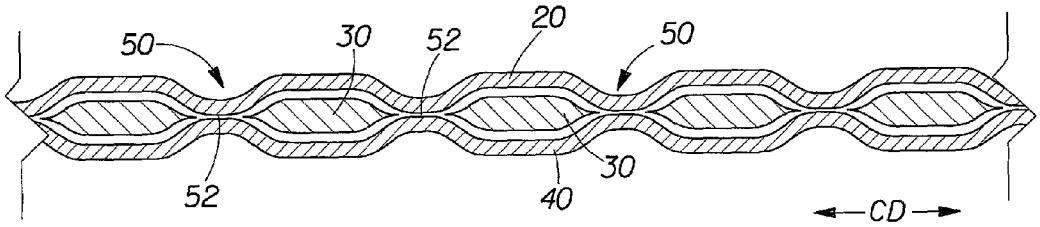
FIG. 2 is a cross-sectional view of a portion of the laminate web shown in FIG. 1.

As shown in FIG. 2, central layer 30 is chosen such that when the constituent web layers of laminate web 10 are processed as detailed below, portions of central layer 30 in the region of the melt bond sites 50 separate to permit the first layer 20 to melt bond directly to the second outer layer 40 at the interface of the two materials 52 at melt bond sites 50. Without being bound by theory, it is believed that the process of the present invention facilitates such separation of central layer 30 by shearing, cutting, or otherwise fracturing the central layer, and displacing the material of the central layer sufficiently to permit thermal bonding of the two outer layers. Thus, central layer 30 should be chosen to have properties that permit such cutting through, such as relatively low extensibility, relatively high frangibility, or relatively high deformability, such that the material of central layer 30 can be "squeezed" out of the region of thermal bond sites 50.

Figure 3:
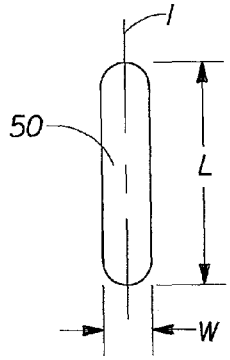
FIG. 3 is a magnified detail view of one bond site of a laminate web of the present invention.

Without being bound by theory, it is believed that to accomplish the bonding of the layers of the laminate web to form apertures therein, the thermal point calendaring described below should form thermal bond sites having a narrow width W dimension and a high aspect ratio. For example, FIG. 3 shows the melt area of a single melt bond site 50 having a narrow width dimension W and a high aspect ratio, i.e., the length, L, is much greater than the width, W. The length L should be selected to permit adequate bond area while width W is sufficiently narrow such that the protuberance used to form the bond site (as described below) can cut, shear, or otherwise pierce the layers 20, 30, 40 at the region of the bond sites by the method described below. Width W can be between about 0.003 inches and 0.020 inches, but in a preferred embodiment, is between about 0.005 inches and 0.010 inches, and may be adjusted depending on the properties of central layer 30.

It is believed that the aspect ratio can be as low as about 3 (i.e., ratio of L/W equals 3/1). It can also be between about 4 and 20. In one preferred embodiment, the aspect ratio was about 10. The aspect ratio of the melt bond sites 50 is limited only by the corresponding aspect ratio of the point bonding protuberances of the calendaring roller(s), as detailed below.

In a preferred embodiment, the longitudinal axis of each bond site, 1, which corresponds directionally to the length dimension of bond site 50, is disposed in a regular, repeating pattern oriented generally in the machine direction, MD as shown in FIG. 1. But the bond sites may be disposed in a regular, repeating pattern oriented in the cross machine direction, or randomly oriented in a mixture of cross and machine directions. For example, the bond sites 50 can be disposed in a "herringbone" pattern.

Another benefit of the present invention is obtained when the thermally bonded laminate web described above is stretched or extended in a direction generally orthogonal to the longitudinal axis, 1, of melt bond sites 50. The melt bonding at the melt bond sites 50 tends to make localized weakened portions of the web at the bond sites. Thus, as portions of the web 10 are extended in a direction generally orthogonal to the longitudinal axis 1 of bond sites 50, the material at the bond site fails in tension and an aperture is formed. The relatively high aspect ratio of melt bond sites 50, permits a relatively large aperture to be formed upon sufficient extension. When the laminate web 10 is uniformly tensioned, the result is a regular pattern of a plurality of apertures 60 corresponding to the pattern of melt bond sites 50.

Figure 4:
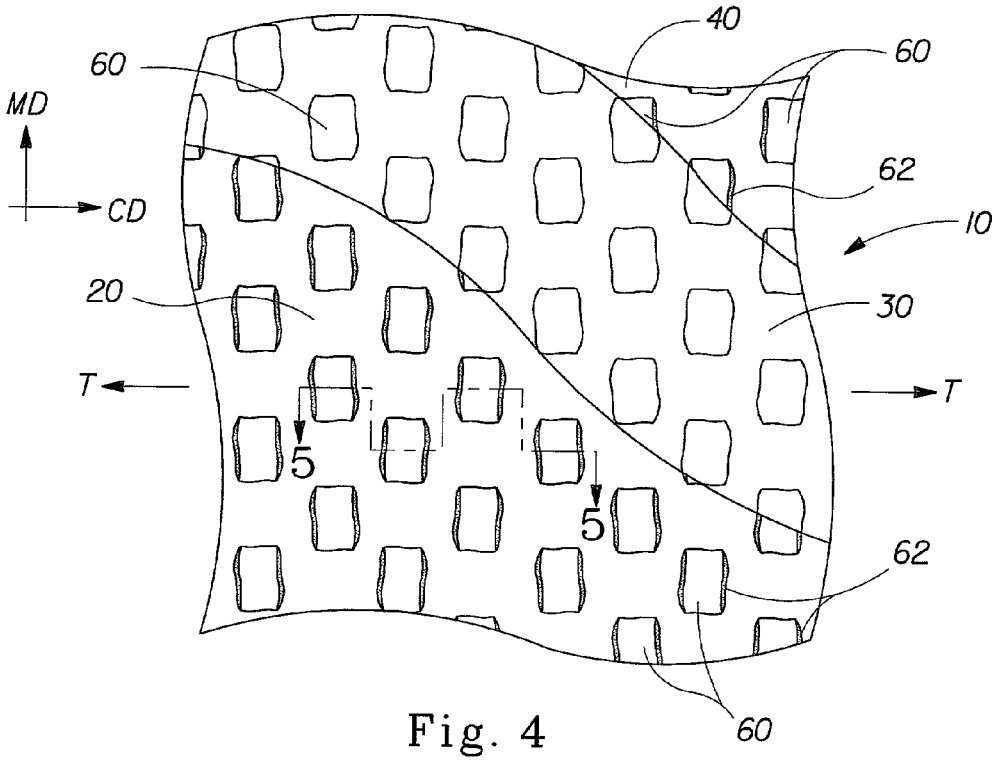
FIG. 4 is a top plan view of another embodiment of the laminate web of the present invention.

FIG. 4 shows a partially cut-away representation of an apertured laminate web useful for the present invention. As shown, the partial cut-away permits each layer or ply to be viewed in a plan view. The laminate web 10 shown in FIG. 4 is produced after the thermally bonded laminate is stretched in a direction orthogonal to the longitudinal axis of the melt bond sites, in this case, in the cross-machine direction, CD. As shown, where formerly were melt bond sites 50, apertures 60 are produced as the relatively weak bond sites fail in tension. Also as shown, central layer 30 can remain generally uniformly distributed within laminate 10, depending on the material properties of central layer 30.

When apertures 60 are formed, the thermally bonded portions of layers 20, 30, 40 remain primarily on the portions of the aperture perimeters corresponding to the length dimension of bond sites 50. Therefore, each aperture 60 does not have a perimeter of thermally bonded material, but only portions remain bonded, represented as 62 in FIG. 4. One beneficial property of such a laminate web is that once apertured, fluid communication with the central layer is facilitated. Thus, an absorbent central layer 30 can be used between two relatively non-absorbent outer layers, and the laminate 10 could be an absorptive wiper with a relatively dry to the touch outer surface.

Figure 5:
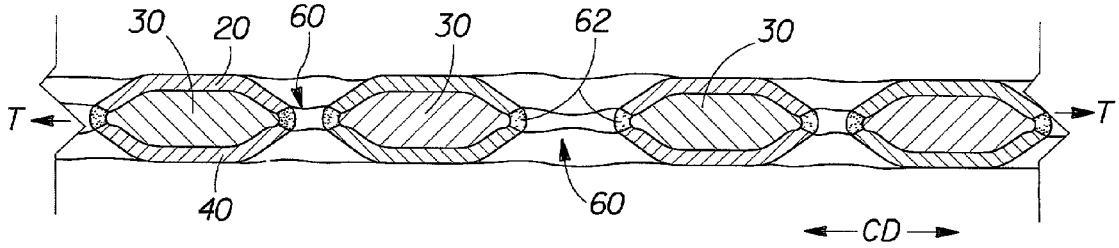
FIG. 5 is a cross-sectional view of a portion of the laminate web shown in FIG. 4.

FIG. 5 is a schematic representation of the cross-section denoted in FIG. 4. As shown, apertures 60 form when the laminate web is elongated in the direction T.

In certain preferred embodiments, the laminate web is characterized by having from about 10% to about 20% of the surface area be "open area." As used herein, "open area" means that the web is apertured or hole-containing such that the amount of material necessary to cover a certain area is minimized due expansion of the web that takes place after stretching/ring rolling. More preferably, the open area of the web is from about 11% to about 17%.

Another benefit of the articles of the present invention that is derived when the laminate web is extended as described with reference to FIG. 4, is that the central layer 30 that has an elongation to break less than either of the two outer layers fails in tension at a lower extensibility than does either of the outer layers. Thus, when the laminate is extended generally orthogonal to the longitudinal axis, 1, of melt bond sites 50, outer layers 20 and 40 extend to form apertures. However, central layer 30, which has an elongation to break less than that of the outer layers, fractures upon sufficient extension, such that after extension central layer 30 is no longer uniformly distributed over the non-apertured regions of the laminate web 10.

An example of one embodiment of a web having a central layer having an elongation to break less than either of the two outer layers is shown partially cut-away in FIG. 5. The partial cut-away permits each layer or ply to be viewed in a plan view. As shown, after extension, central layer 30 becomes fragmented, forming discontinuous regions of the central layer material. These discontinuous regions may be relatively uniformly distributed, such as in rows as shown in FIG. 5, or may be relatively randomly distributed, depending on the pattern of melt bond sites 50 and the method of extension employed. One example of a web 10 having a structure similar to that shown in FIG. 5 is a web having outer layers of relatively extensible nonwovens, with a central layer of relatively low extensibility tissue paper.

Figure 6:
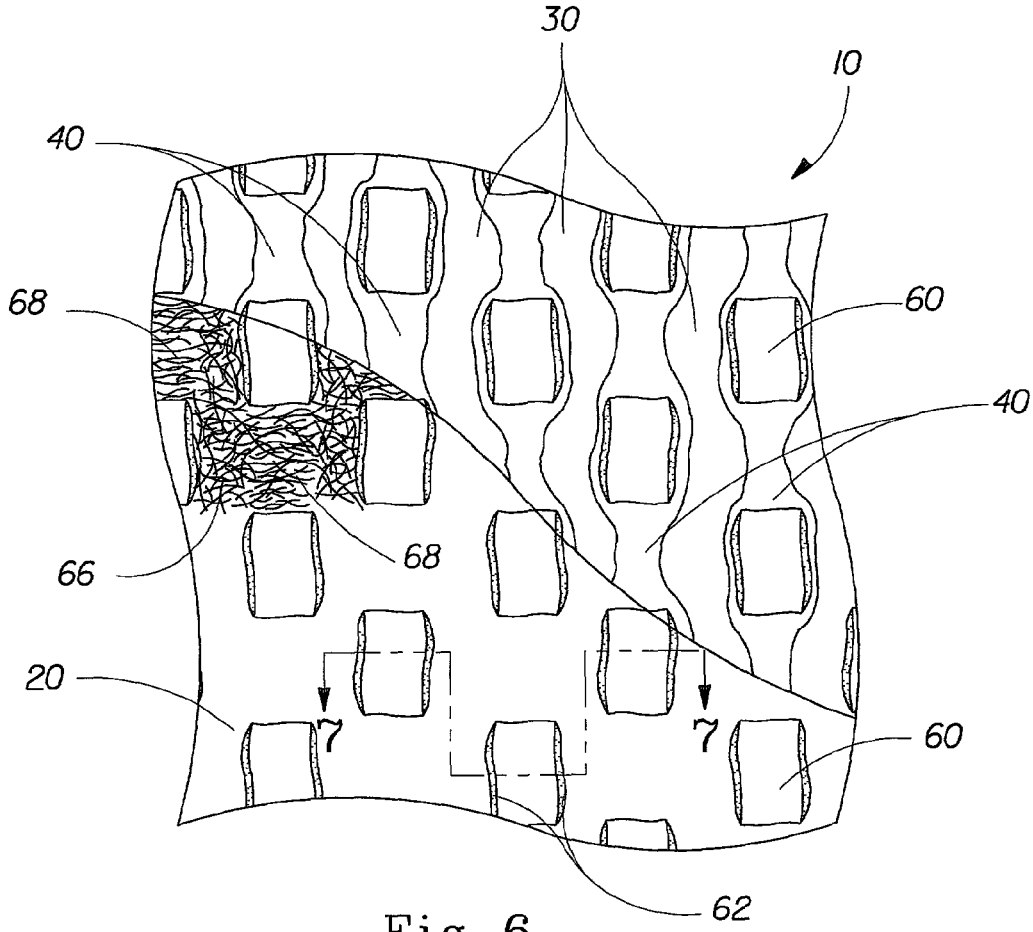
FIG. 6 is a top plan view of another embodiment of the laminate web of the present invention.

A surprising benefit of the laminate web structure described in FIG. 6 is the presence of distinct regions in the non-apertured portion of the web being differentiated by at least one property selected from the group consisting of basis weight, thickness, density, and combinations thereof. As shown in the cross-section of FIG. 7, several such regions can be differentiated. In a preferred embodiment, the regions are visually distinct, giving the laminate web an aesthetically pleasing look and feel that is particularly useful in the articles of the present invention. The regions may also give the laminate a garment-like or knit-like texture.

Figure 7:
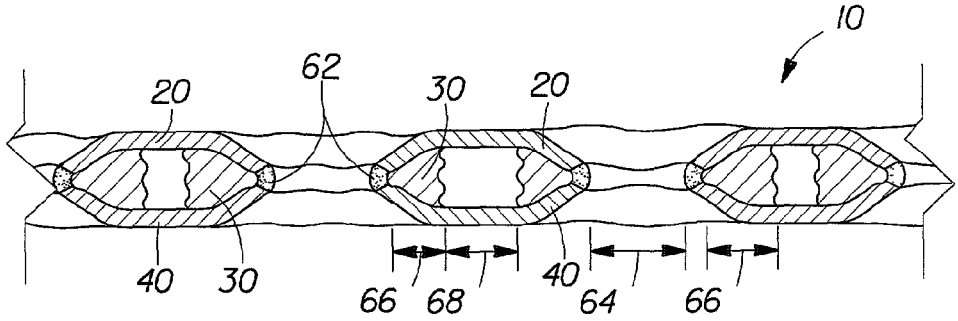
FIG. 7 is a cross-sectional view of a portion of the laminate web shown in FIG. 6.

With reference to FIG. 7, several structurally distinct regions can be identified in the cross-section shown. The region denoted 64 corresponds to the aperture 60. In the non-apertured area of the web, a region 66 is a relatively high basis weight region comprising central layer 30. Region 68 represents the portion of the laminate web in which central layer 30 has fractured and separated, i.e., is no longer fully present, forming a relatively low basis weight region of web 10. In general, the higher basis weight regions will also be correspondingly higher density regions, but need not be so. For example, a post-extension embossing process can be applied to web 10 to form regions of multiple densities in addition to the regions of multiple basis weight. For either the high basis weight regions or the high density regions, often the differences can be discernible by simply rubbing between the fingers.

In general, for a laminate web 10 having generally parallel rows of melt bond sites 50 extending in the machine direction MD, which correspondingly form generally parallel rows of apertures when extended, and having a central layer with a lower elongation to break than the outer layers, the resulting extended, apertured laminate web 10 is characterized by generally low basis weight, low density regions between the apertures in the machine direction, MD, e.g., region 68 in FIGS. 6 and 7. Likewise, the laminate web 10 is characterized by relatively high basis weight, high density regions between adjacent rows of apertures in the cross-machine direction, CD, e.g., region 66 in FIG. 7. By choice of central layer material 30 and possibly post laminating operations, e.g., an embossing process, the thickness of the laminate web can likewise be varied, the thicker regions generally corresponding to the higher density regions.

Another embodiment of a laminate web useful for the present invention may utilize nonwoven webs as the outer layers and be characterized by distinct regions differentiated by fiber orientation. Differential fiber orientation can be achieved by providing for localized regions within the web that experience greater extension than other regions. For example, by locally straining the web 10 to a greater degree in the regions corresponding to regions 68 in FIG. 6, regions of significant fiber reorientation are formed. Such localized straining is possible by the method of the present invention detailed below.

Figure 8:
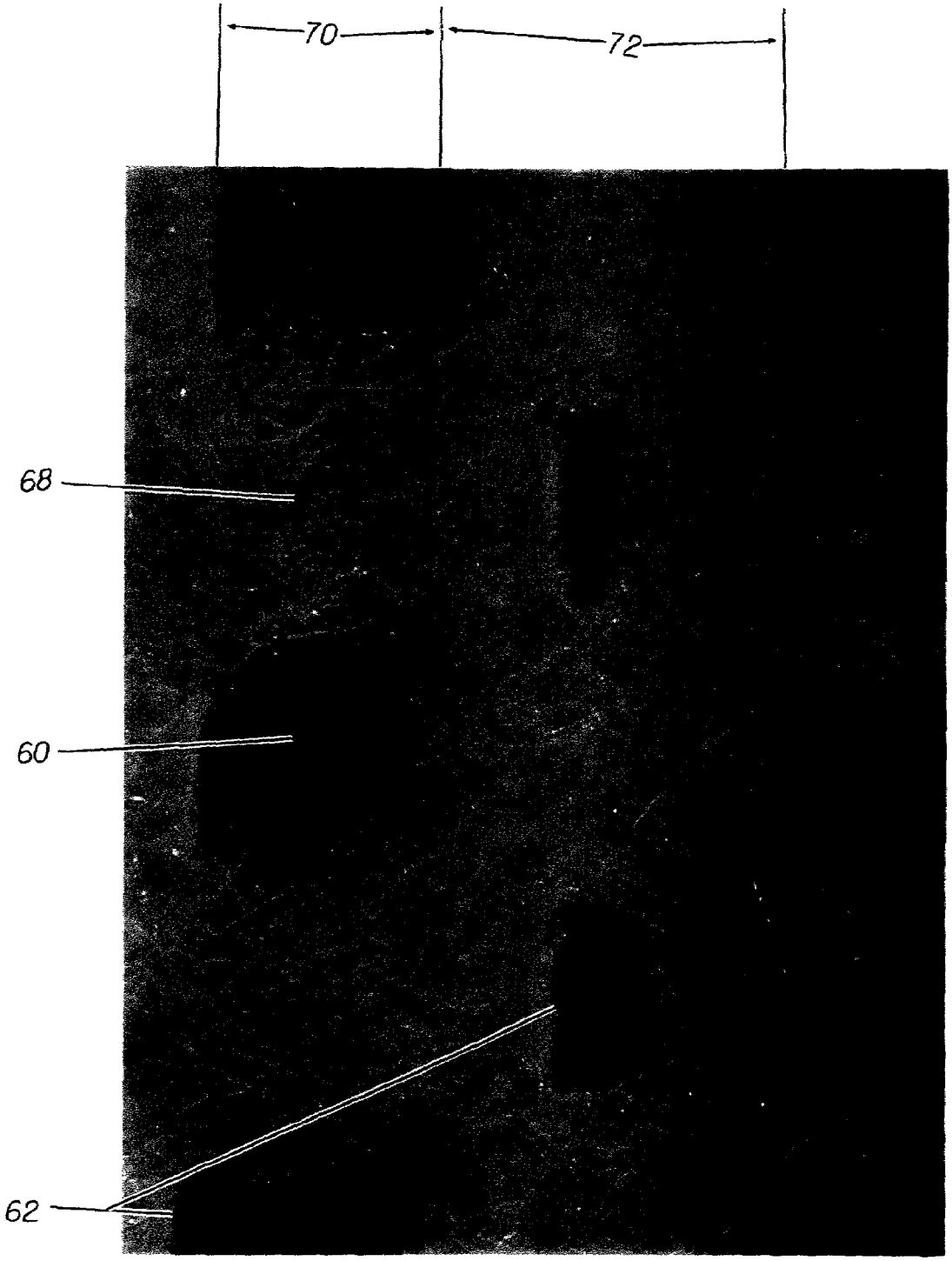
FIG. 8 is a photomicrograph of one embodiment of a laminate web of the present invention.

FIG. 8 is a photomicrograph showing in magnified detail a web of the present invention which has been extended to form apertures, and locally extended to produce regions 68 of fiber reorientation. As can be seen in FIG. 8, by locally extending portions of the web to a greater extent than others, the apertures formed thereby can be of different sizes. Thus, the region denoted generally as 70 in FIG. 8 has undergone more strain (i.e., local extension) than the region denoted by 72. Thus, the apertures in region 70 are larger than those in region 72, and the basis weight of the nonwoven web material in region 72 is less than the basis weight of the nonwoven web in region 70. In addition to the difference in basis weight due to localized strain differentials, the laminate web of the present invention can also exhibit distinct regions 68 of fiber reorientation. In these regions, the fibers have been reoriented from a generally random orientation to a predominant orientation in the direction of extension.

To make a web 10 as shown in FIG. 6, central layer 30 can be any of a great number of dissimilar materials. For example, if outer layers 20 and 40 are nonwoven webs having a relatively high elongation to break, central layer 30 can be paper, tissue paper, thermoplastic film, metal foil, closed or open cell foam, or any other material that has a relatively low elongation to break compared to the two outer layers. The outer layer materials may themselves be dissimilar, with the only constraint being that the central layer be relatively less extensible in the direction of extension to form apertures.

Additionally, more than one central layer 30 can be used with beneficial results. For example, a laminate web comprising a cellulosic tissue central layer and an additional central layer comprising a polymeric film wherein both central layers are disposed between nonwoven first and second outer layers can produce an absorptive wiping article with one side being relatively more absorptive than the other. If the additional polymeric film central layer is a three-dimensional formed film, the film side can provide added texture to the laminate that is beneficial in many wiping applications. Macroscopically-expanded, three-dimensional formed films suitable for use in the present invention include those described in commonly-assigned U.S. Pat. No. 3,929,135 issued to Thompson on Dec. 30, 1975, and U.S. Pat. No. 4,342,314 issued to Radel et al. on Aug. 3, 1982, both patents hereby incorporated herein by reference.

The (or "a") central layer can also be elastomeric, and can be an elastomeric macroscopically-expanded, vacuum-formed, three-dimensional formed film, such as described in commonly-assigned U.S. Ser. No. 08/816,106, entitled "Tear Resistant Porous Extensible Web" filed by Curro et al. on Mar. 14, 1997, and hereby incorporated herein by reference. Further, the (or "a") central layer can be a three-dimensional formed film having micro-apertures such as described in commonly-assigned U.S. Pat. No. 4,629,643 issued to Curro et al. on Dec. 16, 1986, and U.S. Pat. No. 4,609,518, issued to Curro et al. on Sep. 2, 1986, both of which are hereby incorporated herein by reference.

The (or "a") central layer can be a web material having a strainable network as disclosed in U.S. Pat. No. 5,518,801 issued to Chappell et al. on May 21, 1996, and hereby incorporated herein by reference. Such a web can be a structural elastic-like film (SELF) web, formed by, for example, embossing by mating plates or rolls.

The (or "a") central layer can be an absorbent open cell foam web material. Particularly suitable absorbent foams for high performance absorbent articles such as diapers have been made from High Internal Phase Emulsions (hereafter referred to as "HIPE"). See, for example, U.S. Pat. No. 5,260,345 (DesMarais et al), issued Nov. 9, 1993 and U.S. Pat. No. 5,268,224 (DesMarais et al), issued Dec. 7, 1993, hereby incorporated herein by reference. These absorbent HIPE foams provide desirable fluid handling properties, including: (a) relatively good wicking and fluid distribution characteristics to transport the imbibed urine or other body fluid away from the initial impingement zone and into other regions of the foam structure to allow for subsequent gushes of fluid to be accommodated; and (b) a relatively high storage capacity with a relatively high fluid capacity under load, i.e. under compressive forces.

The central layer 30 may further comprise absorbent gelling materials. For example, supersorbers or hydrogel materials may provide for superior absorbency when the laminate web of the present invention is used as an absorbent wipe or a core in a disposable absorbent article of the present invention. By "hydrogel" as used herein is meant an inorganic or organic compound capable of absorbing aqueous fluids and retaining them under moderate pressures. For good results the hydrogels should be water insoluble. Examples are inorganic materials such as silica gels and organic compounds such as cross-linked polymers. Cross-linking may be by covalent, ionic, van der Waals, or hydrogen bonding. Examples of polymers include polyacrylamides, polyvinyl alcohol, ethylene maleic anhydride copolymers, polyvinyl ethers, hydroxypropyl cellulose, carboxymethyl cellulose, polyvinyl pyridine and the like. Suitable gelling materials are described below in the "optional ingredients" that relates to the personal care articles of the present invention. It should be understood, however, that such gelling materials may also be utilized in each of the articles of the present invention, irrespective of the intended use of the article.

The structure of the laminate web is particularly useful in the assembly of the articles of the present invention since the web can be made of dissimilar materials without the use of adhesive for joining. The plurality of melt bond sites 50 are sufficient to keep the component webs together in the laminate web, so that the laminate web behaves as a unitary web for processing integrity and use, without unwanted delamination. However, in some embodiments, and for certain materials, it may be beneficial to apply adhesive between at least two of the constituent layers.

Method of Making The Laminate Web

Figure 9:
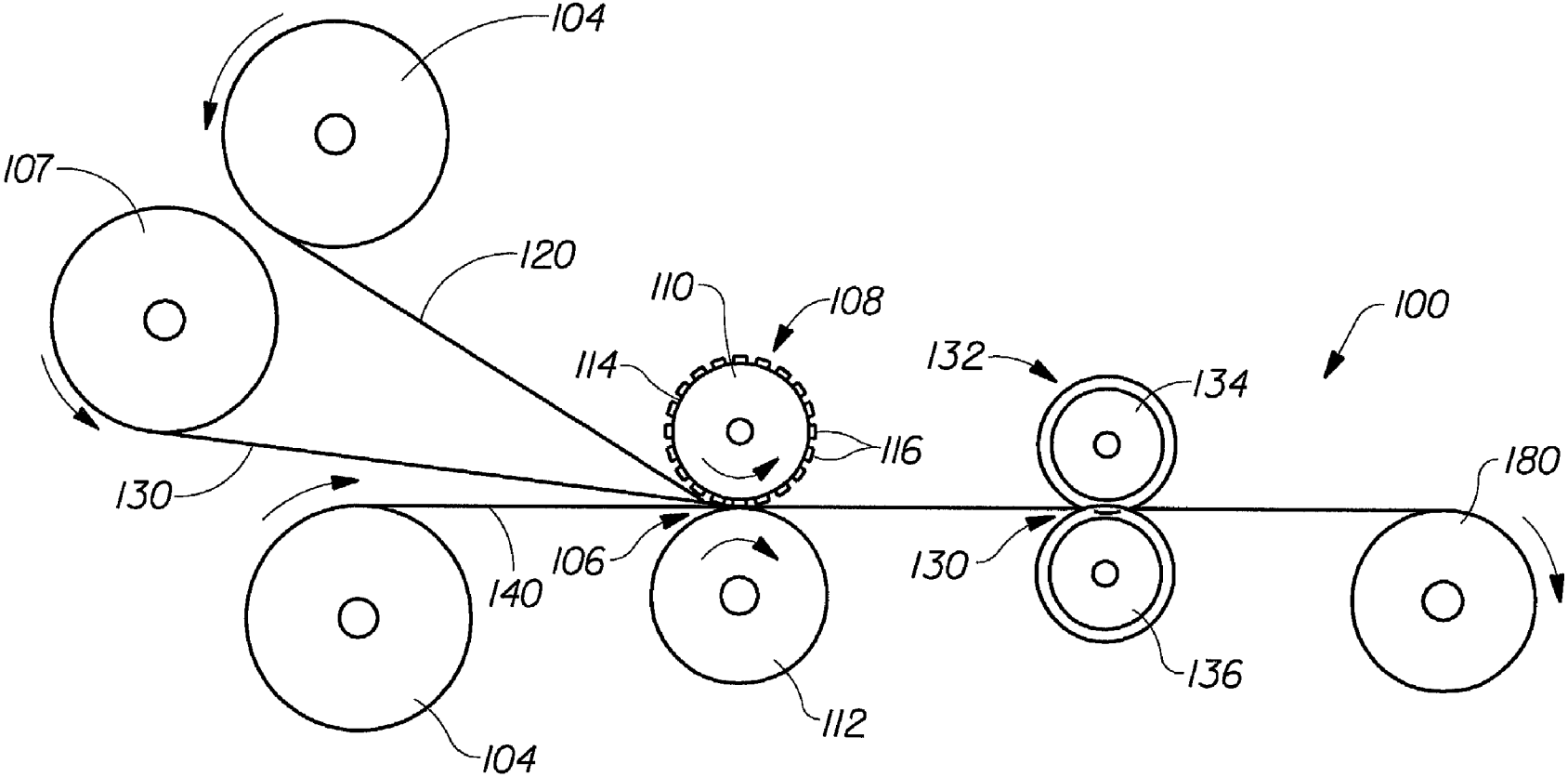
FIG. 9 is a schematic representation of a process for making a laminate web of the present invention.

Referring to FIG. 9 there is schematically illustrated at 100 a process for making a laminate web of the present articles.

Generally, the soil redeposition inhibiting agents can be entangled in and/or adhered onto the laminate web. The laminate web is then desirably encased in a semi-permeable sheet through the use of solid state post formation technology ("SSPFT") forming a DEC article. The outer layer of the DEC article is preferably a semi-permeable material such as a polyester and polypropylene bi-component sheet, preferably at a weight ratio of 80:20. The structure of the DEC article allows for vapor transfer into and out of the inner ply(s) of the DEC article, thus providing a flow-by as well as the flow-through mechanism for vapor transfer.

A more detailed explanation of the DEC article making process follows. A first relatively extensible web 120 is unwound from a supply roll 104 and travels in a direction indicated by the arrows associated therewith as the supply roll 104 rotates in the direction indicated by the arrows associated therewith. Likewise a second relatively extensible web 140 is unwound from supply roll 105. A central layer 130 is likewise drawn from supply roll 107. The three components (or more, if more than one central layer is used) pass through a nip 106 of the thermal point bond roller arrangement 108 formed by rollers 110 and 112.

Either outer layer can comprise a formed film, such as a three-dimensional formed film having micro-apertures such as described in commonly-assigned U.S. Pat. No. 4,629,643 issued to Curro et al. on Dec. 16, 1986, and U.S. Pat. No.4,609,518, issued to Curro et al. on Sep. 2, 1986, both of which are hereby incorporated herein by reference.

In a preferred embodiment, both outer layers comprise nonwoven materials, and may be the identical. The nonwoven material may be formed by known nonwoven extrusion processes, such as, for example, known meltblowing processes or known spunbonding processes, and passed directly through the nip 106 without first being bonded and/or stored on a supply roll. However, in a preferred embodiment, the nonwoven webs are themselves thermally point bonded (consolidated) webs commercially available on supply rolls.

The nonwoven web outer layer(s) may be elastic or nonelastic so long as the third central layer is less extensible than both the first and second outer layers. The nonwoven web may be any melt-fusible web, including a spunbonded web, a meltblown web, or a bonded carded web. If the nonwoven web is a web of meltblown fibers, it may include meltblown microfibers. The nonwoven web may be made of fiber forming polymers such as, for example, polyolefins. Exemplary polyolefins include one or more of polypropylene, polyethylene, ethylene copolymers, propylene copolymers, and butene copolymers. The nonwoven web can have a basis weight between about 10 to about 60 grams per square meter (gsm), and more preferably about 15 to about 30 gsm.

The nonwoven outer layers may themselves each be a multilayer material having, for example, at least one layer of a spunbonded web joined to at least one layer of a meltblown web, a bonded carded web, or other suitable material. For example, the nonwoven web may be a multilayer web having a first layer of spunbonded polypropylene having a basis weight from about 0.2 to about 8 ounces per square yard, a layer of meltblown polypropylene having a basis weight from about 0.2 to about 4 ounces per square yard, and a second layer of spunbonded polypropylene having a basis weight from about 0.2 to about 8 ounces per square yard. Alternatively, the nonwoven web may be a single layer of material, such as, for example, a spunbonded web having a basis weight from about 0.2 to about 10 ounces per square yard or a meltblown web having a basis weight from about 0.2 to about 8 ounces per square yard.

The nonwoven web outer layers may also be a composite made up of a mixture of two or more different fibers or a mixture of fibers and particles. Such mixtures may be formed by adding fibers and/or particulates to the gas stream in which the meltblown fibers or spunbond fibers are carried so that an intimate entangled co-mingling of fibers and other materials, e.g., wood pulp, staple fibers and particles occurs prior to collection of the fibers.

Prior to processing the laminate web as described herein, the outer cover of the fibers of the respective layers can be joined by bonding to form a coherent web structure. Suitable bonding techniques include, but are not limited to, chemical bonding, ultrasonic bonding, thermobonding, such as point calendering, hydroentangling, and needling.

Figure 10:
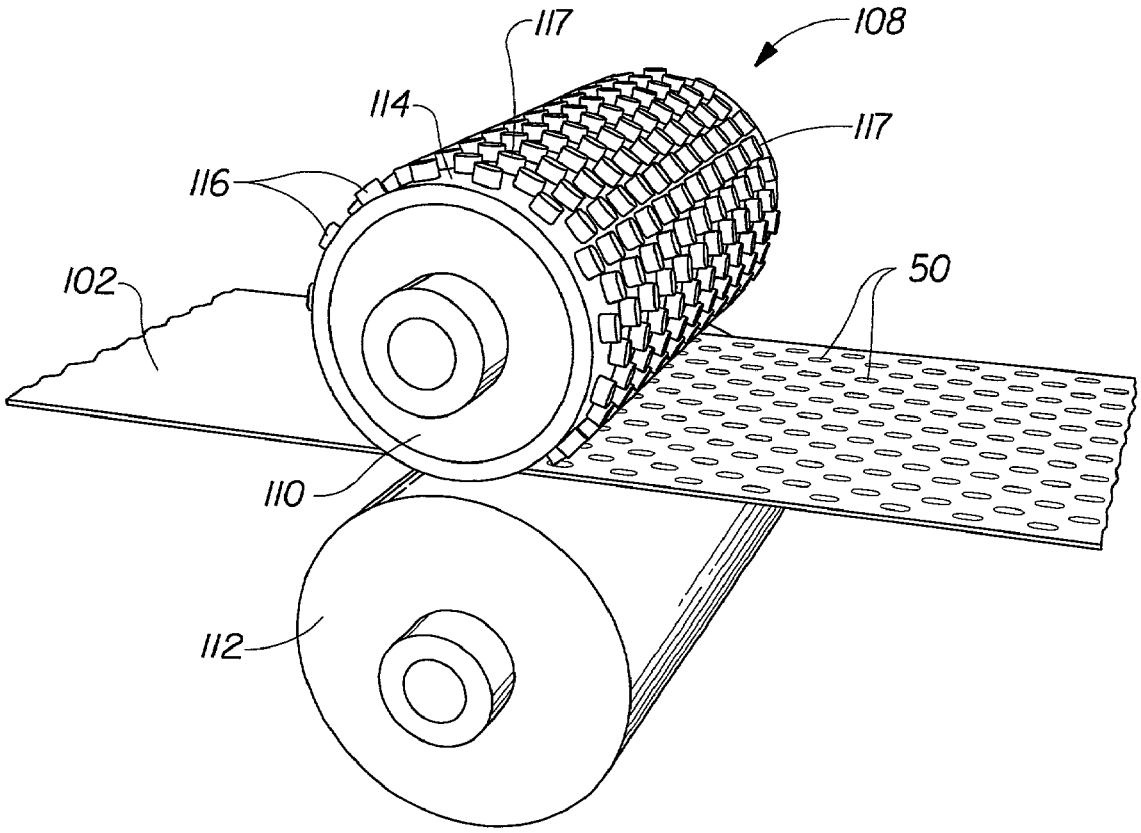
FIG. 10 is a perspective view of a melt bond calendaring apparatus.

Referring to FIGS. 9 and 10, the nonwoven thermal bond roller arrangement 108 preferably comprises a patterned calendar roller 110 and a smooth anvil roller 112. One or both of the patterned calendar roller 110 and the smooth anvil roller 112 may be heated and the pressure between the two rollers may be adjusted by well known means to provide the desired temperature, if any, and pressure to concurrently displace central layer 30 at melt bond sites, and melt bond the two outer layers together at a plurality of bond sites.

Figure 11:
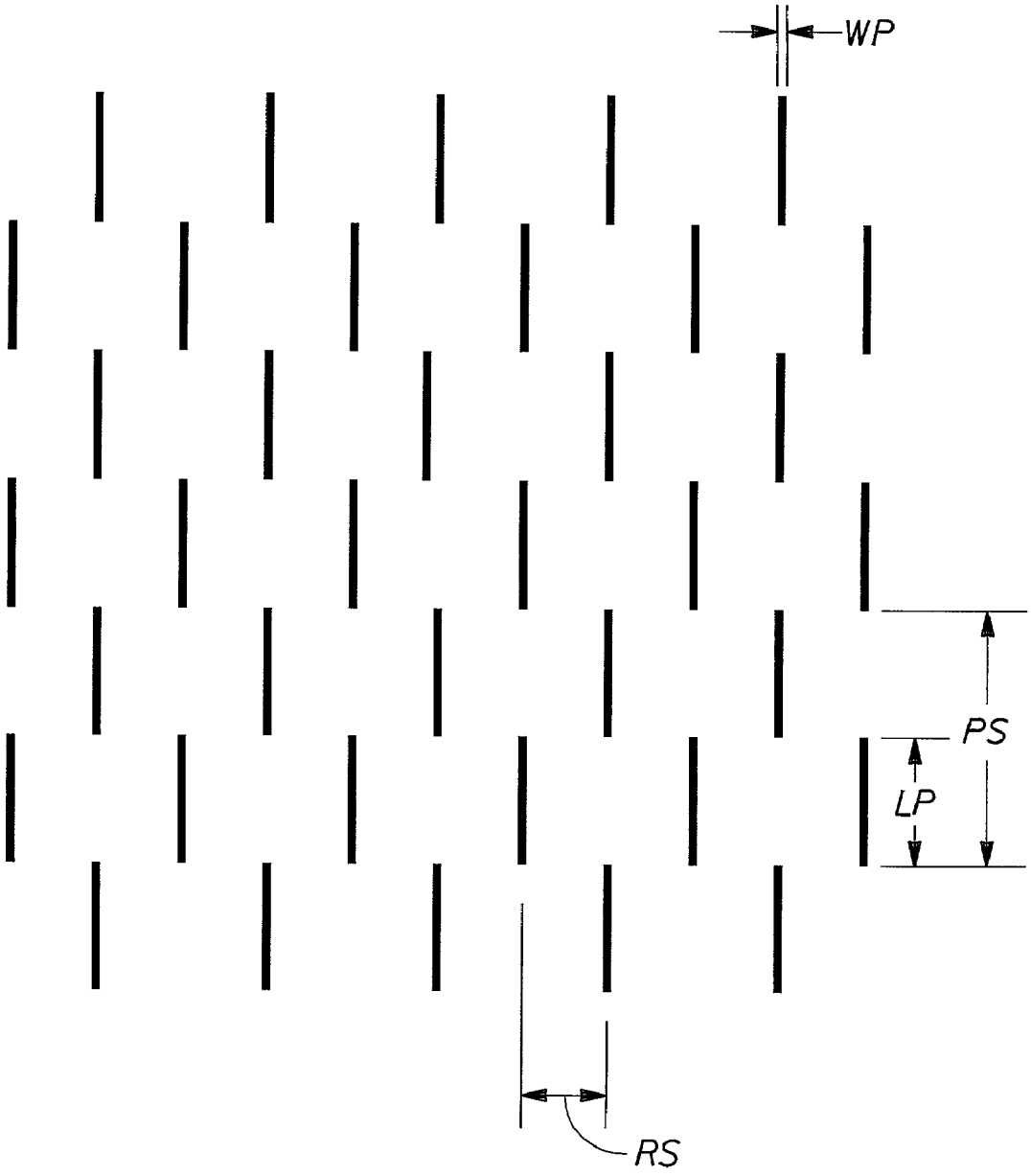
FIG. 11 is a schematic representation of a pattern for the protuberances of the calendaring roll.

The patterned calendar roller 110 is configured to have a circular cylindrical surface 114, and a plurality of protuberances or pattern elements 116 which extend outwardly from surface 114. The protuberances 116 are disposed in a predetermined pattern with each protuberance 116 being configured and disposed to displace central layer 30 at melt bond sites, and melt bond the two outer layers together at a plurality of locations. One pattern of protuberances is shown in FIG. 11. As shown, the protuberances 116 have a relatively small width, WP, which can be between about 0.003 inches and 0.020 inches, but in a preferred embodiment is about 0.010 inches. Protuberances can have a length, LP, of between about 0.030 inches and about 0.200 inches, and in a preferred embodiment has a length of about 0.100 inches. In a preferred embodiment, the protuberances have an aspect ratio of 10. The pattern shown is a regular repeating pattern of staggered protuberances, generally in rows, each separated by a row spacing, RS, of about between about 0.010 inches and about 0.200 inches. In a preferred embodiment, row spacing RS is about 0.060 inches. The protuberances can be spaced apart within a row by a protuberance spacing, PS generally equal to the protuberance length, LP. But the spacing and pattern can be varied in any way depending on the end product desired.

As shown in FIG. 10, patterned calendar roller 110 can have a repeating pattern of protuberances 116 which extend about the entire circumference of surface 114. Alternatively, the protuberances 116 may extend around a portion, or portions of the circumference of surface 114. Likewise, the protuberances 116 may be in a non-repeating pattern, or in a repeating pattern of randomly oriented protuberances.

The protuberances 116 are preferably truncated conical shapes which extend radially outward from surface 114 and which have rectangular or somewhat elliptical distal end surfaces 117. Although it is not intended to thereby limit the scope of the present invention to protuberances of only this configuration, it is currently believed that the high aspect ratio of the melt bond site 50 is only achievable if the protuberances likewise have a narrow width and a high aspect ratio at the distal end surfaces 117, as shown above with reference to FIG. 11. Without being bound by theory, it is believed that other suitable shapes for distal ends 117 may include, but are not limited to circular, square, rectangular, etc., if they facilitate the bonding and aperturing of the laminate web. The roller 110 is preferably finished so that all of the end surfaces 117 lie in an imaginary right circular cylinder which is coaxial with respect to the axis of rotation of roller 110.

The height of the protuberances should be selected according to the thickness of the laminate being bonded. In general, the height dimension should be greater than the maximum thickness of the laminate web during the calendaring process, so that adequate bonding occurs at the bond sites, and only at the bond sites.

Anvil roller 112, is preferably a smooth surfaced, right circular cylinder of steel.

After passing through nip 106, the three (or more) component webs 120, 130, and 140 have been formed into laminate web 10. At this point in the process the outer layers are thermally bonded and unapertured, as shown in FIGS. 1 and 2. Central layer(s) 30, from web 130, is apertured, having been displaced by protuberances 116 in nip 106.

The laminate web 10 may be further processed to form apertures in the whole laminate web extending portions of the web in a direction orthogonal to the axis 1 of bond sites 50. It is by this process that the open area of the web is formed. As shown in FIGS. 9 and 10, the axis 1 is generally parallel to the machine direction MD of the web being processed. Therefore, extension in the cross-direction CD at the bonded portions causes the bond sites 50 to rupture and open to form apertures in the web.

One method for forming apertures across the web is to pass the web through nip 130 formed by an incremental stretching system 132 employing opposed pressure applicators 134 and 136 having three-dimensional surfaces which at least to a degree are complementary to one another. Stretching of the laminate web may be accomplished by other methods known in the art, including tentoring, or even by hand. However, to achieve even strain levels across the web, and especially if localized strain differentials are desired, the incremental stretching system disclosed herein is preferred.

Figure 12:
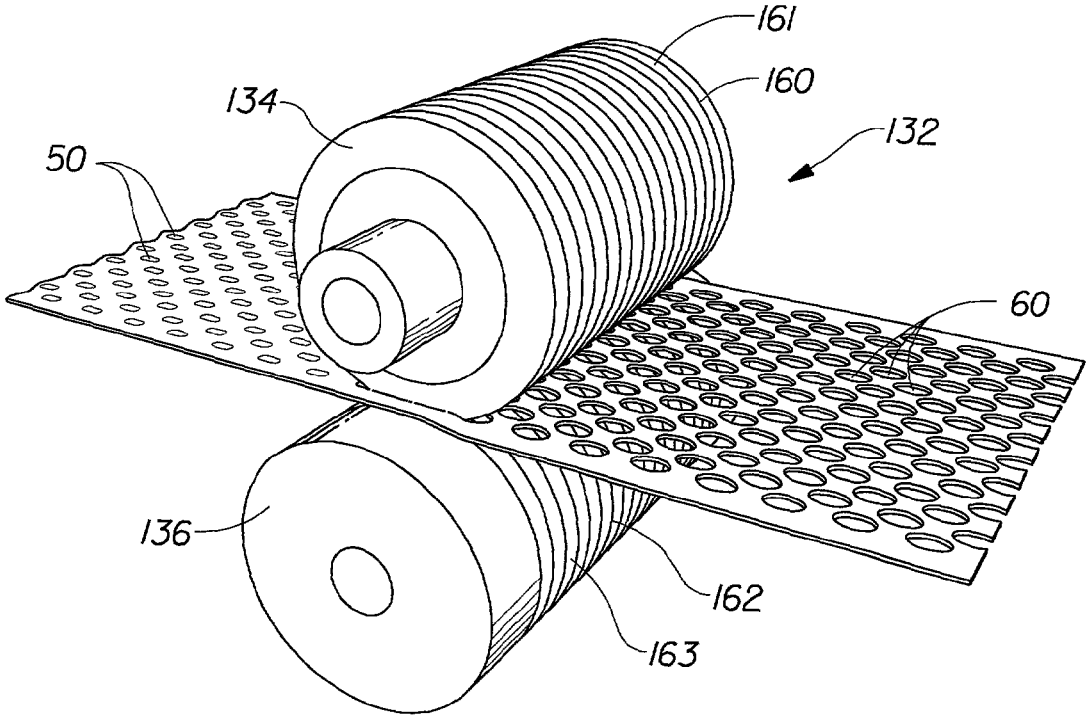
FIG. 12 is a perspective view of an apparatus for stretching a laminate of the present invention to form apertures therein.
Figure 13:
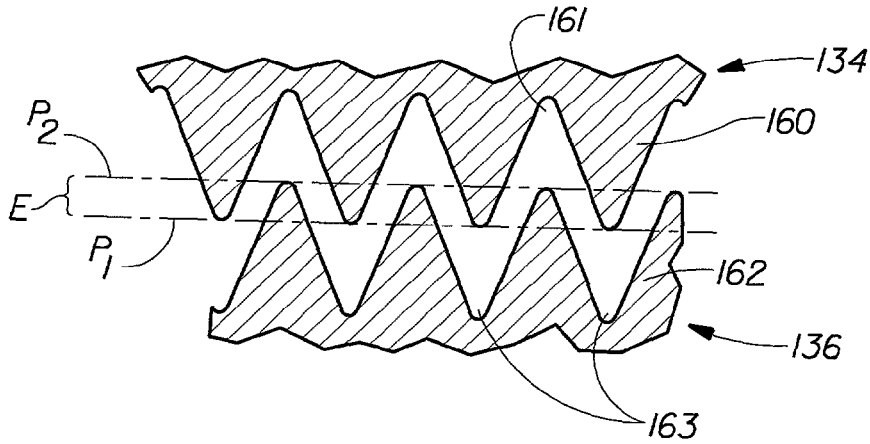
FIG. 13 is a cross-sectional view of a portion of the mating portions of the apparatus shown in FIG. 12.

Referring now to FIG. 12, there is shown a fragmentary enlarged view of the incremental stretching system 132 comprising incremental stretching rollers 134 and 136. The incremental stretching roller 134 includes a plurality of teeth 160 and corresponding grooves 161 which extend about the entire circumference of roller 134. Incremental stretching roller 136 includes a plurality of teeth 162 and a plurality of corresponding grooves 163. The teeth 160 on roller 134 intermesh with or engage the grooves 163 on roller 136, while the teeth 162 on roller 136 intermesh with or engage the grooves 161 on roller 134. The teeth of each roller are generally triangular-shaped, as shown in FIG. 13. The apex of the teeth may be slightly rounded, if desired for certain effects in the finished web.

With reference to FIG. 13, which shows a portion of the intermeshing of the teeth 160 and 162 of rollers 134 and 136, respectively. The term "pitch" as used herein, refers to the distance between the apexes of adjacent teeth. The pitch can be between about 0.02 to about 0.30 inches, and is preferably between about 0.05 and about 0.15 inches. The height (or depth) of the teeth is measured from the base of the tooth to the apex of the tooth, and is preferably equal for all teeth. The height of the teeth can be between about 0.10 inches and 0.90 inches, and is preferably about 0.25 inches and 0.50 inches.

The teeth 160 in one roll can be offset by one-half the pitch from the teeth 162 in the other roll, such that the teeth of one roll (e.g., teeth 160) mesh in the valley (e.g., valley 163) between teeth in the mating roll. The offset permits intermeshing of the two rollers when the rollers are "engaged" or in an intermeshing, operative position relative to one another. In a preferred embodiment, the teeth of the respective rollers are only partially intermeshing. The degree to which the teeth on the opposing rolls intermesh is referred to herein as the "depth of engagement" or "DOE" of the teeth. As shown in FIG. 13, the DOE, E, is the distance between a position designated by plane P1 where the apexes of the teeth on the respective rolls are in the same plane (0% engagement) to a position designated by plane P2 where the apexes of the teeth of one roll extend inward beyond the plane P1 toward the valley on the opposing roll. The optimum or effective DOE for particular laminate webs is dependent upon the height and the pitch of the teeth and the materials of the web.

In other embodiments the teeth of the mating rolls need not be aligned with the valleys of the opposing rolls. That is, the teeth may be out of phase with the valleys to some degree, ranging from slightly offset to greatly offset.

As the laminate web 10 having melt bonded locations 50 passes through the incremental stretching system 132 the laminate web 10 can be subjected to tensioning in the CD or cross-machine direction causing the laminate web 10 to be extended in the CD direction. Alternatively, or additionally the laminate web 10 may be tensioned in the MD (machine direction). The tensioning force placed on the laminate web 10 can be adjusted (e.g., by adjusting DOE) such that it causes the melt bonded locations 50 to separate or rupture creating a plurality of apertures 60 coincident with the melt bonded locations 50 in the laminate web 10. However, portions of the melt bonds of the laminate web 10 remain, as indicated by portions 62 in FIG. 4, thereby maintaining the nonwoven web in a coherent condition even after the melt bonded locations rupture.

After being subjected to the tensioning force applied by the incremental stretching system 132, the laminate web 10 includes a plurality of apertures 60 which are coincident with the melt bonded regions 50 of the laminate web. As mentioned, a portion of the circumferential edges of apertures 60 include remnants 62 of the melt bonded locations 60. It is believed that the remnants 60 help to resist further tearing or delamination of the laminate web.

Figure 14:
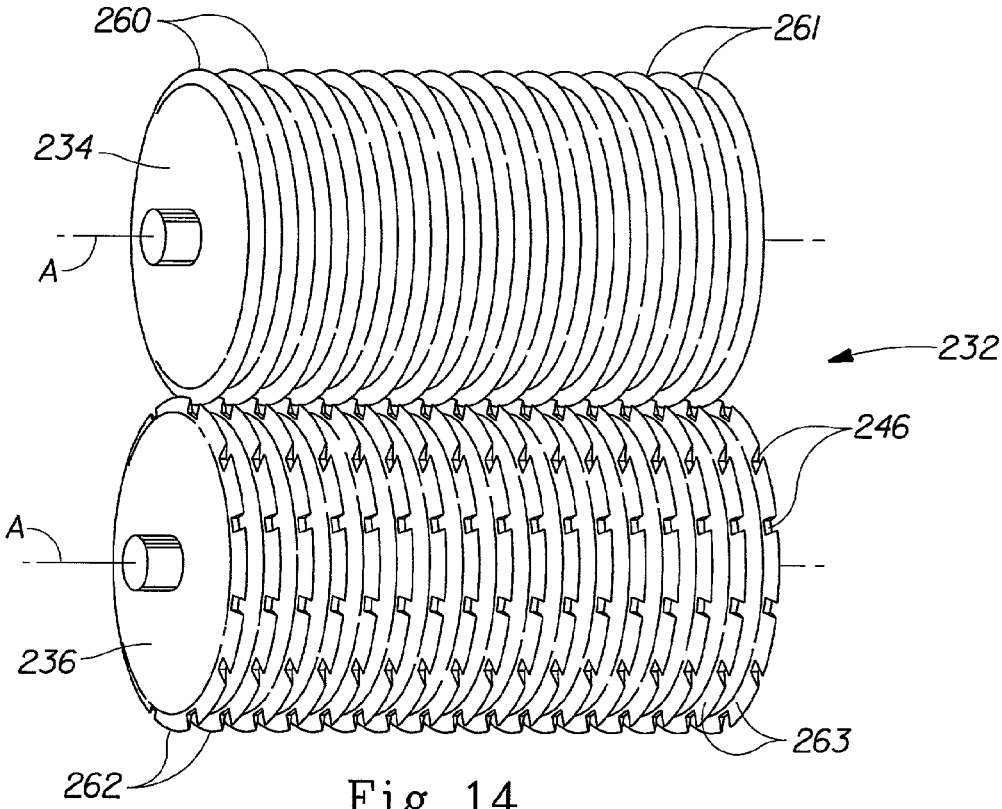
FIG. 14 is a perspective view of an alternative apparatus for stretching a laminate of the present invention in the cross-machine direction to form apertures therein.

Instead of two substantially identical rolls 134 and 136, one or both rolls can be modified to produce extension and additional patterning. For example, one or both rolls can be modified to have cut into the teeth several evenly-spaced thin planar channels 246 on the surface of the roll, as shown on roll 236 in FIG. 14. In FIG. 14 there is shown an enlarged view of an alternative incremental stretching system 232 comprising incremental stretching rollers 234 and 236. The incremental stretching roller 234 includes a plurality of teeth 260 and corresponding grooves 261 which extend about the entire circumference of roller 234. Incremental stretching roller 236 includes a plurality of teeth 262 and a plurality of corresponding grooves 263. The teeth 260 on roller 234 intermesh with or engage the grooves 263 on roller 236, while the teeth 262 on roller 236 intermesh with or engage the grooves 261 on roller 234. The teeth on one or both rollers can have channels 246 formed, such as by machining, such that regions of undeformed laminate web material may remain after stretching. A suitable pattern roll is described in U.S. Pat. No. 5,518,801, issued May 21, 1996, in the name of Chappell, et al., the disclosure of which is incorporated herein by reference.

Figure 15:
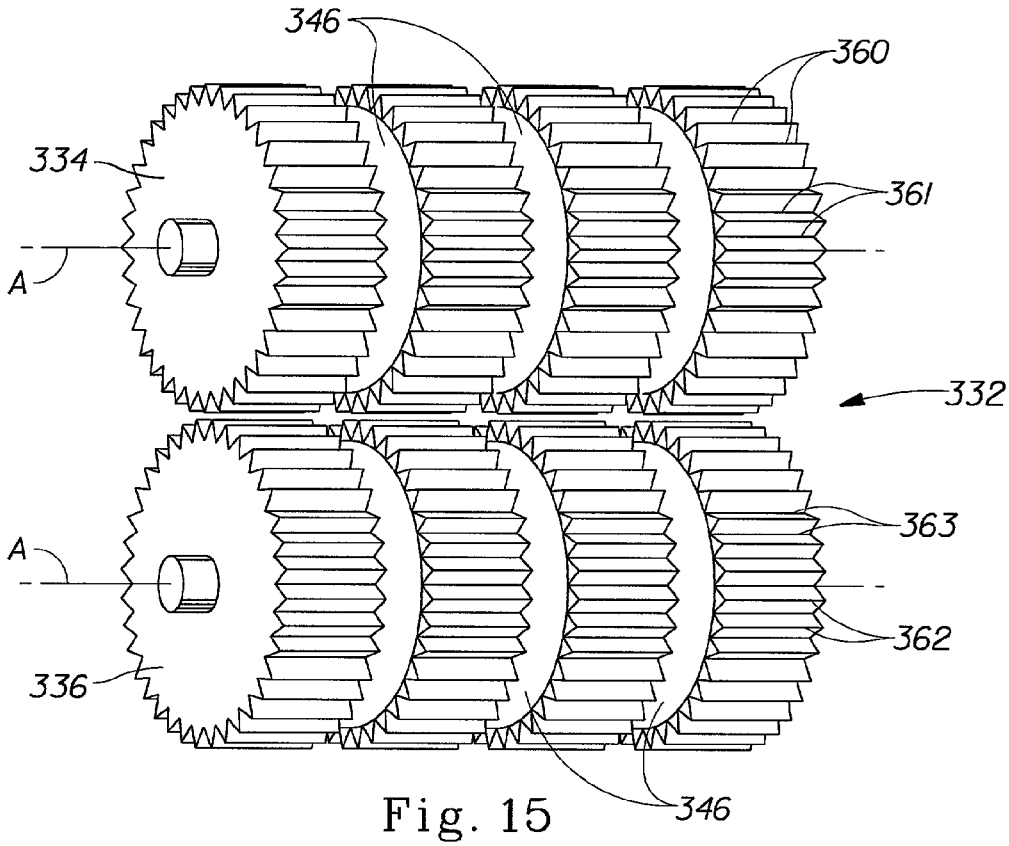
FIG. 15 is a perspective view of another alternative apparatus for stretching a laminate of the present invention in the machine direction to form apertures therein.

Likewise, the incremental stretching can be by mating rolls oriented as shown in FIG. 15. Such rolls comprise a series of ridges 360, 362, and valleys, 361, 363 that run parallel to the axis, A, of the roll, either 334 or 336, respectively. The ridges form a plurality of triangular-shaped teeth on the surface of the roll. Either or both rolls may also have a series of spaced-apart channels 346 that are oriented around the circumference of the cylindrical roll. Rolls as shown are effective in incrementally stretching a laminate having bond sites 50 having the axis 1 oriented generally parallel to the cross-machine (CD) direction of the web as its being processed.

Figure 16:
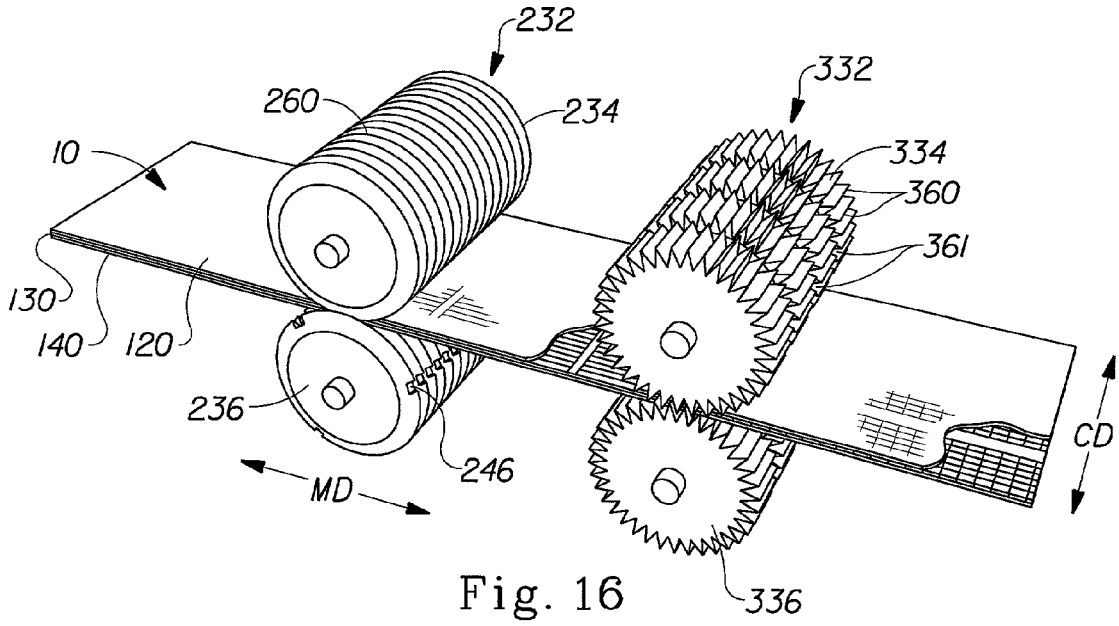
FIG. 16 is a perspective representation of an apparatus for stretching a laminate of the present invention in both the cross-machine and machine directions to form apertures therein.
Figure 17:
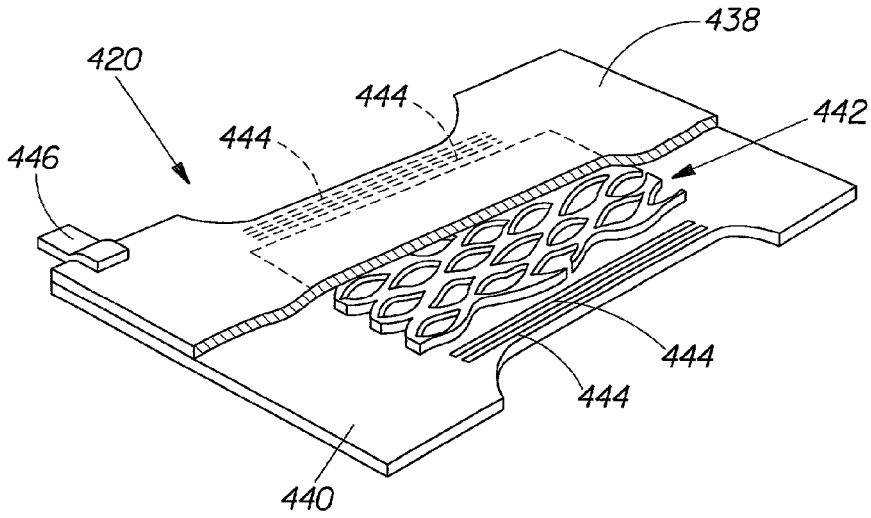
FIG. 17 is a perspective view of a disposable absorbent article having components that can be made of laminate web material of the present invention.

In one embodiment, the method of the making the laminate web of the articles of the present invention can comprise both CD and MD incremental stretching. As shown in FIG. 16, two pairs of incremental stretching rolls can be used in line, such that one pair (232, which, as shown in FIG. 16 includes a series of spaced-apart channels 246) performs CD stretching, and another pair, 332 performs MD stretching. By this method many interesting fabric-like textures can be made to be incorporated into the articles of the present invention. The resulting hand and visual appearance make such fabric-like webs ideal for use in the articles of the present invention.

In a preferred embodiment the soil redeposition inhibiting article of the present invention comprises a material which is a multiply substrate having one or more hydrophobic outer plies, preferably polyethylene and/or nylon, preferably nylon-6, and one or more hydrophilic inner plies, preferably cellulosic, more preferably absorbent.

Soil redeposition inhibiting articles in accordance with the present invention comprising such material has been found to surprisingly resist folding, especially refolding upon itself even after an initial fold has been formed in the soil redeposition inhibiting article. Further, such soil redeposition inhibiting articles tend to unfold from a folded state upon use.

The soil redeposition inhibiting articles of the present invention may comprise apertures. The apertures are preferably formed and/or arranged in such a way as to reduce the tendency of the soil redeposition inhibiting article to fold, especially refold upon itself even after an initial fold has been formed in the soil redeposition inhibiting article.

Figure 18:
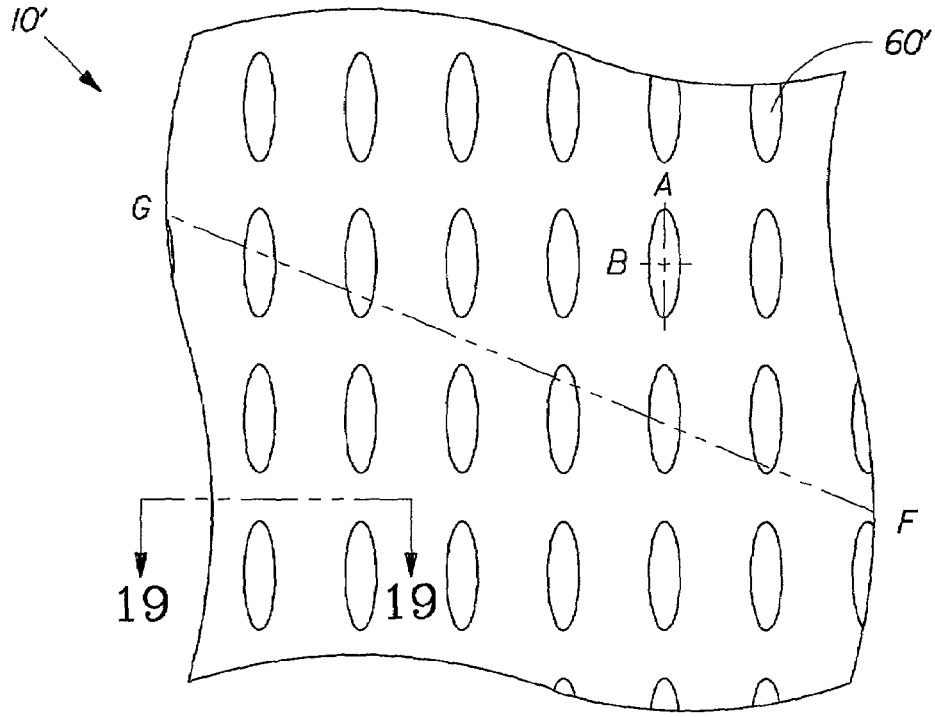
FIG. 18 is a schematic illustration of an embodiment of a cleaning sheet in accordance with the present invention.

As shown in FIG. 18, a soil redeposition inhibiting article 10' in accordance with the present invention comprises apertures 60' preferably formed and/or arranged in such a way as to reduce the tendency of the soil redeposition inhibiting article 10' to fold. Each aperture 60' preferably has a major axis A and a minor axis B, preferably the major axis A is at least 1.5 times the length of the minor axis B. A fold line F-G when formed in such a soil redeposition inhibiting article 10' as shown in FIG. 18 is preferably formed substantially parallel to the minor axis B of the apertures. Substantially parallel to the minor axis of the aperture means that the fold line is positioned at an angle less than 90°, preferably less than 70°, more preferably less than 45° to the minor axis.

The apertures may be made by any suitable process known in the art. A nonlimiting example of a suitable process is described hereinabove.

Figure 19:
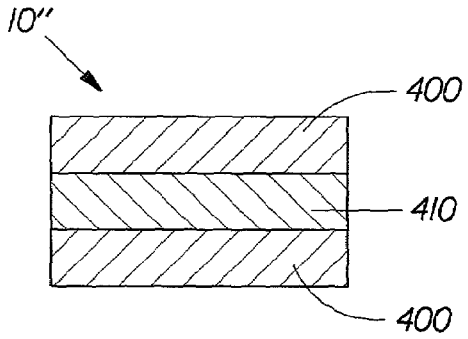
FIG. 19 is a schematic cross-sectional view of an embodiment of a cleaning sheet in accordance with the present invention.

In addition to materials and apertures useful in the soil redeposition inhibiting articles of the present invention, as shown in FIG. 19 a soil redeposition inhibiting article 10" in accordance with the present invention may include an outer sheet 400 (coversheet) and an inner sheet 410 wherein the outer sheet 400 wholly or partially, preferably wholly, encases the inner sheet 410.

The outer sheet 400 preferably is hydrophobic and the inner sheet 410 is preferably hydrophilic.

The outer sheet 400 can be made hydrophobic by any process known in the art, such as by printing the sheet with a hydrophobic ink, applying a paint and/or other materials to render the sheet hydrophobic.

Figure 20:
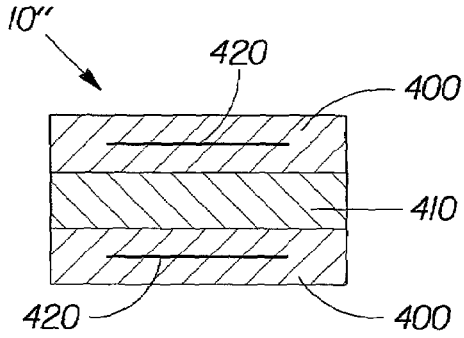
FIG. 20 is a schematic cross-sectional view of an embodiment of a cleaning sheet in accordance with the present invention.

In a preferred embodiment as shown in FIG. 20, the outer sheet 400 comprises crepe 420, preferably a discrete layer of crepe.

Preferably, soil redeposition inhibiting articles comprising outer sheets that wholly or partially encase inner sheets are arranged such that the outer sheets and inner sheets can contract and/or expand independent of one another. More preferably, the outer sheets and inner sheets are arranged such that when an initial fold line is formed in the soil redeposition inhibiting article the fold line in the outer and inner sheets are aligned, and then upon use of the soil redeposition inhibiting article the fold line in the outer and inner sheets become nonaligned such that the soil redeposition inhibiting article resists folding.

b. Containment Bag

The carrier and/or housing or reservoir of the present invention may comprise a containment bag and/or part thereof. A containment bag may comprise a compartment within the interior volume of the bag such that a soil redeposition inhibiting agent article is positioned within the interior volume of the bag such that during use the soil redeposition inhibiting agent provides its benefit(s) to fabrics within the bag. Alternatively, the interior lining or portion thereof of the bag may comprise a soil redeposition inhibiting article in accordance with the present invention.

The containment bag may be a venting or non-venting bag. The containment bag may be fabric or non-fabric, woven or non-woven. The containment bag may be a reusable containment bag.

In one embodiment, the containment bag may be a heat-resistant vapor-venting bag. More preferably it is tetrahedral in shape during use, such as is described in WO 00/37733.

Typically, the bags herein will have an internal volume of from about 10,000 cm3 to about 25,000 cm3. Bags in this size range are sufficient to accommodate a reasonable load of fabrics (e. g., 0.2–5 kg) without being so large as to block dryer vents in most U.S.-style home dryers. Somewhat smaller bags may be used in relatively smaller European and Japanese dryers.

Typically, such bags may be prepared from 0.025 mm to 0.076 mm (1–3 mil) thickness polymer sheets. If more rigidity in the bag is desired, somewhat thicker sheets can be used.

In addition to thermally stable"nylon-only"bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer"shell"comprising a heat-resistant material such as nylon or polyethylene terephthalate and an inner sheet of a polymer which provides a vapor barrier. The non-woven outer shell protects the bag from melting and provides an improved tactile impression to the user. In yet another alternate mode, the bag is a fabric and/or woven bag made of polyethylene terephthalate.

The soil redeposition inhibiting articles of the present invention may comprise a consumer signal component to communicate to the consumer the state of the soil redeposition inhibiting article. For example, the consumer signal may communicate to the consumer that the soil redeposition inhibiting article has been used and/or partially used or in other words that the cleaning composition of the soil redeposition inhibiting article has been consumed and/or partially consumed. In another example, the consumer signal may communicate that the soil redeposition inhibiting article has not been used or in other words that the cleaning composition of the soil redeposition inhibiting article has not been consumed.

The consumer signal component comprises a material that is capable of being sensed by a consumer's sensory system, such as sight, touch, smell and/or hearing.

Such consumer signal components may be noticeable prior to use and unnoticeable upon use (consumption) and/or the consumer signal components may be unnoticeable prior to use and noticeable upon use (consumption).

Nonlimiting examples of such consumer signal components include the following, visual marks such as trademarks, logos, and the like that are incorporated into the soil redeposition inhibiting article, colors such that the soil redeposition inhibiting article changes colors upon use (consumption), colors such that lint, dirt and/or other particulates are visible upon the soil redeposition inhibiting article after use (consumption), perfume such that a perfume scent is either noticeable prior to use (consumption) or noticeable after use (consumption), additional materials incorporated into and/or on the soil redeposition inhibiting article such that the additional materials separate from the soil redeposition inhibiting article upon use (consumption). Nonlimiting examples of such additional materials include particulates, crystals, nonwoven materials and/or woven materials.

Kits

The soil redeposition inhibiting articles of the present invention may be incorporated into kits. Such kits typically comprise one or more soil redeposition inhibiting articles.

In another embodiment, a kit in accordance with the present invention comprises one or more soil redeposition inhibiting articles and a containment bag according to the present invention. Nonlimiting examples of suitable containment bags are described in U.S. Pat. Nos. 5,789,368 and 5,681,355 and U.S. patent application Ser. No. 60/190,640.

In another embodiment, a kit in accordance with the present invention comprises one or more soil redeposition inhibiting articles and a stain remover system. Nonlimiting examples of stain remover systems are described in U.S. Pat. Nos. 5,891,197, 5,872,090, 5,849,039, 5,789,368 and 5,681,355 and U.S. patent application Ser. No. 60/190,640. Typically the stain remover system comprises a stain removal composition as well as an absorbent stain receiver article.

In another embodiment, a kit in accordance with the present invention may comprise a soil redeposition inhibiting agent, which may be alone or associated with a soil redeposition inhibiting article in accordance with the present invention, and instructions for using the soil redeposition inhibiting agent for treating soil-containing fabrics such that the soil on the fabrics is reduced. The instructions may comprise placing the soil redeposition inhibiting agent in soil influencing proximity to the soil-containing fabrics such that the soil on the fabrics is reduced.

Cleaning/Refreshment Composition

The soil redeposition inhibiting articles of the present invention may comprise a cleaning/refreshment composition releasably absorbed in the soil redeposition inhibiting article. By "releasably contains" means that the composition is effectively released from the soil redeposition inhibiting article onto an article, preferably soiled fabrics as part of a non-immersion cleaning and fabric refreshment process as described herein. This release occurs mainly by volatilization of the composition from the soil redeposition inhibiting article.

The cleaning/refreshment composition may comprise water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. and in U.S. Pat. No. 5,591,236, which issued on Jan. 7, 1997 to Roetker. The entire disclosure of the You et al. and the Roetker patents are incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

It is especially preferred that the cleaning/refreshment compositions of this invention include a shrinkage reducing composition, which is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1 ,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

In addition to the above ingredients, the cleaning/refreshment composition may optionally comprise a bleaching agent, preferably hydrogen peroxide.

Stain Removal Composition

Amine Oxides—The stain removal composition may comprise a tertiary amine oxide having the formula:

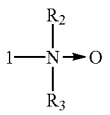

wherein $R_1$ is a $C_{10}$–$C_{25}$ linear or branched alkyl group, and $R_2$ and $R_3$ are independently selected from $C_1$–$C_4$ alkyl groups and $C_2$–$C_4$ hydroxy alkyl groups; from about 0.01% to about 5% by weight of the composition of a surfactant selected from the group consisting of anionic surfactants, nonionic surfactant, cationic surfactants, zwitterionic surfactants and mixtures thereof, preferably an alkyl sulfate anionic surfactant or alkyl ether carboxylates; and the balance detergent adjunct ingredients; wherein the molar ratio of amine oxide to total surfactant is from about 5:4 to about 9:1 and the composition is substantially free of halide bleaching agents.

Diamines—The stain removal composition may comprise a diamine. In one embodiment, it is an organic diamine. If a diamine is present in the compositions of the present invention, it is preferably present at a level of from about 0.25% to about 15%, more preferably from about 0.30% to about 5%, most preferably from about 0.30% to about 2% by weight of the composition.

Suitable organic diamines may have pK1 and pK2 in the range of about 8.0 to about 11.5, preferably in the range of about 8.4 to about 11, even more preferably from about 8.6 to about 10.75. Preferred materials for performance and supply considerations are 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25.degree. C. and for an ionic strength between 0.1 to 0.5M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., JEFFAMINE EDR 148®, (namely 1,2-bis(2-aminoethoxy)ethane). In addition, materials based on ethylene diamine are unsuitable.

The diamines useful herein can be defined by the following structure:

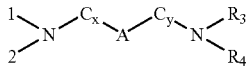

wherein $R_{1-4}$ are independently selected from H, methyl, ethyl, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater, preferably 2 or greater.

Examples of preferred diamines include the following:

Dimethyl aminopropyl amine

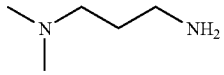

1,6-Hexane diamine

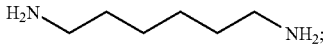

1,3-Propane diamine

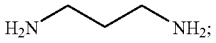

2-Methyl 1,5-pentane diamine

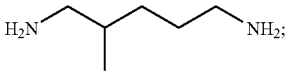

1,3-Pentadiamine, available under the tradename DYTEK EP

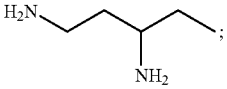

1-Methyl-diaminiopropane or 1,3-Diaminobutane

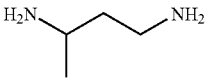

JEFFAMINE EDR 148®, (1,2-bis(2-aminoethoxy)ethane)

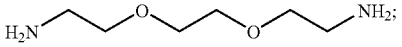

Isophorone diamine

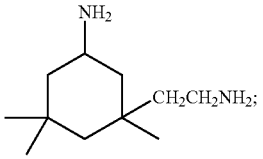

1,3-bis(methylamine)-cyclohexane or 1,3-cyclohexanebis (methylamine)

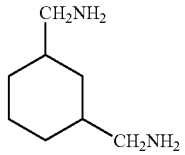

and mixtures thereof.

The following Examples further illustrate the invention, but are not intended to be limiting thereof.

EXAMPLE I

Cleaning/Refreshment Compositions

A. Fabric cleaning/refreshment compositions according to the present invention, for use in a containment bag, are prepared as follows:

| Ingredient | % (wt.) |
|---|---|
| Organic solvent* | 0.5 |
| Soil redeposition inhibiting agent | 5.0 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

B. Additionally, preferred compositions for use in the in-dryer cleaning/refreshment step of the process herein are as follows.

| Ingredient | % (wt.) | Range (% wt.) |
|---|---|---|
| Water | 99.0 | 0.1–99.9 |
| Perfume | 0.5 | 0.05–1.5 |
| Soil redeposition inhibiting agent | 2.5 | 0.1–90.0 |
| Surfactant | 0.5 | 0.05–2.0 |
| Ethanol or Isopropanol | 0 | Optional to 4% |
| Solvent (e.g. BPP) | 0 | Optional to 4% |
| pH range from about 6 to about 8. | | |

C. Additionally, preferred compositions for use in the in-dryer cleaning/refreshment step of the process herein are as follows:

| Ingredient | % (wt.) | % (wt.) | % (wt.) | % (wt.) |
|---|---|---|---|---|
| Water | 96.63 | 96.85 | 72.22 | 93.21 |
| Soil redeposition inhibiting agent | 1.0 | 2.0 | 5.0 | 3.5 |
| Perfume | 0 | 0.38 | 0.38 | 0 |
| Surfactant | 0.285 | 0 | 0 | 0.285 |
| Solvent (e.g. BPP) | 2.0 | 0 | 0 | 2.0 |
| KATHON ® | 0.0003 | 0 | 0 | 0 |
| Organic solvent* | 0 | 0.5 | 0.38 | 0 |
| Amine Oxide | 0.0350 | 0 | 0 | 0.0350 |
| $MgCl_2$ | 0.045 | 0 | 0 | 0 |
| $MgSO_4$ | 0 | 0 | 0.058 | 0 |
| Hydrogen Peroxide | 0 | 0 | 0 | 0.6 |
| Citric Acid | 0 | 0 | 0 | 0.05 |
| Proxel GXL | 0 | 0.08 | 0.08 | 0 |
| Bardac 2250 | 0 | 0.2 | 0.2 | 0 |
| 1,2-Propanediol | 0 | 0 | 21.75 | 0 |

*Polyoxyethylene (20) sorbitan monolaurate available from ICI Surfactants.

Besides the other ingredients, the foregoing compositions can contain enzymes to further enhance cleaning performance, as described in the Trinh et al. patent incorporated herein above.

Even though water is a component of the above-described cleaning/refreshment compositions, it can be absent from the soil redeposition inhibiting articles of the present invention, especially if water (moisture) is added into the fabric treating system in another manner, such as in a separate discrete sheet.

EXAMPLE II

A kit in accordance with the present invention comprises the following:

a. one or more soil redeposition inhibiting articles according to the present invention, wherein the articles may further comprise cleaning/refreshment compositions according to the present invention; and b. optionally, one or more cleaning sheets containing cleaning/refreshment compositions according to the present invention; and c. optionally, one or more containment bags, woven or non-woven, plastic or fabric, preferably fabric, venting or non-venting, preferably venting; and d. optionally, one or more bottles of stain removal solution of the formula:

| Ingredients | A | B | C | D | E | F |
|---|---|---|---|---|---|---|
| Alkyl sulfate | 0.050 | 0.050 | 0.050 | 0.035 | 0.035 | 0.035 |
| Amine Oxide | 0.45 | 0.45 | 0.45 | 0.285 | 0.285 | 0.285 |
| Citric Acid | 0.060 | 0.060 | 0.060 | 0.0375 | 0.0375 | 0.0375 |
| Diamine | 0.070 | 0.070 | 0.070 | 0.045 | 0.045 | 0.045 |
| BPP | 0.0 | 2.0 | 2.0 | 2.0 | 0.0 | 2.0 |
| Preservative | 0.0003 | 0.0 | 0.0003 | 0.0 | 0.0003 | 0.0003 |
| Water | to balance | to balance | to balance | to balance | to balance | to balance |

e. and optionally, one or more absorbent stain receiver pads, preferably comprising TBAL, LBAL, MBAL or HIPE; and
f. optionally, instructions for using any of a.-e. to treat a fabric substrate.

e. and optionally, one or more absorbent stain receiver pads, preferably comprising TBAL, LBAL, MBAL or HIPE; and f. optionally, instructions for using any of a.–e. to treat fabric substrate.

What is claimed is:

1. A soil redeposition inhibiting article comprising:

a) an effective amount of a soil redeposition inhibiting agent selected from the group consisting of cyclodextrin, uncomplexed cyclodextrin, zeolite, activated carbon, silicas, doped silicas, zinc oxides, and mixtures thereof and b) a dryer containment bag, said dryer containment bag having an internal volume of from about 10,000 $cm^3$ to about 25,000 $cm^3$;

wherein said soil redeposition inhibiting agent and a soil-containing dry, or essentially dry, fabric is contained within said dryer containment bag, such that said soil redeposition inhibiting agent is capable of controlling soils and said soil redeposition inhibiting article contains an effective amount of said soil redeposition inhibiting agent to provide a reduction in soil present on a dry or essentially dry fabric upon being exposed to said dry fabrics, especially in a heated environment, as compared to a dry or essentially dry fabric not exposed to said soil redeposition inhibiting agent.

2. The article according to claim 1 wherein said soil redeposition inhibiting agents are non-volatile soil redeposition inhibiting agents.

3. The article according to claim 2 wherein said non-volatile soil redeposition inhibiting agents comprise a material that reacts with amines, sulfur-containing compounds, fatty acids, and mixtures thereof.

4. The article according to claim 1 wherein said article comprises activated carbons and silicas.

5. The article according to claim 4 wherein said activated carbons and silicas are present in said article at a weight ratio of activated carbons to silicas of less than about 1.

6. The article according to claim 5 wherein said activated carbons and silicas are present in said article at a weight ratio of activated carbons to silicas of from about 20:80 to about 1:99.

7. The article according to claim 6 wherein said activated carbons and silicas are present in said article at a weight ratio of activated carbons to silicas of from about 1:99 to about 4:96.

8. The article according to claim 1 wherein said soil redeposition inhibiting agent comprises two or more different soil redeposition inhibiting agents having comparable particle sizes.

9. A method for removing soil from a soil-containing fabric comprising placing a soil redeposition inhibiting article according to claim 1 in soil influencing proximity of said soil-containing fabric such that soil from said soil-containing fabric is reduced.

10. A soil reduced fabric produced by the method according to claim 9.

11. An article according to claim 1 wherein said sail redeposition inhibiting agent is present in said article at a level of from about 0.0001 to about 300 grams of soil redeposition inhibiting agent per article.

12. A system for removing soils from a soil-containing dry or essentially dry fabric, comprising placing the soil-containing dry or essentially dry fabric in soil-influencing proximity to a soil redeposition inhibiting agent selected from the group consisting of cyclodextrin, uncomplexed cyclodextrin, zeolite, activated carbon, silicas, doped silicas, zinc oxides, and mixtures thereof;

such that the soil present on the soil-containing dry or essentially dry fabric is reduced and placing the soil-containing dry or essentially dry fabric and the soil-redeposition inhibiting agent in a dryer containment bag, said dryer containment bag having an internal volume of from about 10,000 $cm^3$ to about 25,000 $cm^3$.

13. An article of manufacture comprising a soil redeposition inhibiting article according to claim 1 wherein said article of manufacture further comprises instructions for using said soil redeposition inhibiting article to reduce soils present on a soil-containing dry or essentially dry fabric, said instructions comprising the steps of placing the soil redeposition inhibiting article in soil influencing proximity to said soil-containing dry or essentially dry fabric such tat the soil is reduced.

14. A kit comprising:

a) at least one soil redeposition inhibiting article according to claim 1; and b) optionally, a stain removal solution; and c) optionally, an absorbent stain receiver article; and d) optionally, instructions for using said soil redeposition inhibiting article to remove soils from a soil-containing dry or essentially dry fabric; and e) optionally, a cleaning refreshment composition, preferably contained in a cleaning sheet.

15. A kit comprising:

a) at least one soil redeposition inhibiting article according to claim 1; and b) instructions comprising placing the at least one soil-redeposition inhibiting article in soil influencing proximity to a soil-containing fabric article in need of treatment.

* * * * *